US010349197B2

(12) United States Patent
Jo et al.

(10) Patent No.: US 10,349,197 B2
(45) Date of Patent: Jul. 9, 2019

(54) METHOD AND DEVICE FOR GENERATING AND PLAYING BACK AUDIO SIGNAL

(71) Applicant: SAMSUNG ELECTRONICS CO., LTD., Suwon-si (KR)

(72) Inventors: Hyun Jo, Seoul (KR); Sun-min Kim, Yongin-si (KR); Jae-ha Park, Suwon-si (KR); Sang-mo Son, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 62 days.

(21) Appl. No.: 15/503,521

(22) PCT Filed: Aug. 13, 2015

(86) PCT No.: PCT/KR2015/008529
§ 371 (c)(1),
(2) Date: Feb. 13, 2017

(87) PCT Pub. No.: WO2016/024847
PCT Pub. Date: Feb. 18, 2016

(65) Prior Publication Data

US 2017/0251323 A1 Aug. 31, 2017

Related U.S. Application Data

(60) Provisional application No. 62/163,041, filed on May 18, 2015, provisional application No. 62/037,088, filed on Aug. 13, 2014.

(51) Int. Cl.
*H04S 5/00* (2006.01)
*H04S 7/00* (2006.01)
*G10L 19/008* (2013.01)

(52) U.S. Cl.
CPC ..... *H04S 5/005* (2013.01); *H04S 5/00* (2013.01); *H04S 7/30* (2013.01); *H04S 7/303* (2013.01);

(Continued)

(58) Field of Classification Search
None
See application file for complete search history.

(56) References Cited

U.S. PATENT DOCUMENTS 7,333,622 B2 2/2008 Algazi et al.
7,539,319 B2 5/2009 Dickins et al.
(Continued)

FOREIGN PATENT DOCUMENTS

CN 102860048 A 1/2013
CN 103329576 A 9/2013
(Continued)

OTHER PUBLICATIONS

International Search Report and Written Opinion (PCT/ISA/210 & PCT/ISA/237) dated Dec. 4, 2015, issued by the International Searching Authority in counterpart International Application No. PCT/KR2015/008529.

(Continued)

*Primary Examiner* — Paul W Huber
(74) *Attorney, Agent, or Firm* — Sughrue Mion, PLLC

(57) ABSTRACT

According to an aspect of an embodiment, an audio generation method includes: receiving an audio signal through at least one microphone; generating an input channel signal corresponding to each of the at least one microphone based on the received audio signal; generating a virtual input channel signal based on the input channel signal; generating additional information including reproduction locations of the input channel signal and the virtual input channel signal; and transmitting a multi-channel audio signal and the additional information, the multi-channel audio signal including the input channel signal and the virtual input channel signal.

13 Claims, 28 Drawing Sheets

(52) U.S. Cl.
CPC ..... *H04S 7/305* (2013.01); *G10L 19/008* (2013.01); *H04S 2400/01* (2013.01); *H04S 2400/05* (2013.01); *H04S 2400/11* (2013.01); *H04S 2400/15* (2013.01); *H04S 2420/01* (2013.01); *H04S 2420/11* (2013.01)

(56) References Cited

U.S. PATENT DOCUMENTS

| | | | | |
|---|---|---|---|---|
| 8,259,970 | B2 | 9/2012 | Kim | |
| 8,885,839 | B2 | 11/2014 | Kim | |
| 9,154,895 | B2 | 10/2015 | Son et al. | |
| 9,241,218 | B2 | 1/2016 | Walther | |
| 9,462,387 | B2 | 10/2016 | Oomen et al. | |
| 2009/0252356 | A1 | 10/2009 | Goodwin et al. | |
| 2010/0296672 | A1 | 11/2010 | Vickers | |
| 2010/0328419 | A1 | 12/2010 | Etter | |
| 2013/0101122 | A1 | 4/2013 | Yoo et al. | |
| 2013/0272527 | A1 | 10/2013 | Oomen et al. | |
| 2013/0329922 | A1 | 12/2013 | Lemieux et al. | |
| 2015/0350802 | A1 | 12/2015 | Jo et al. | |
| 2016/0064003 | A1* | 3/2016 | Mehta | G10L 19/008 381/23 |
| 2016/0266865 | A1* | 9/2016 | Tsingos | H04S 7/304 |
| 2018/0167756 | A1* | 6/2018 | Mateos Sole | H04S 3/008 |
| 2018/0268829 | A1* | 9/2018 | France | G10L 19/008 |

FOREIGN PATENT DOCUMENTS

| | | | |
|---|---|---|---|
| EP | 2 540 101 | B1 | 9/2017 |
| KR | 1020100062784 | A | 6/2010 |
| KR | 1020100084319 | A | 7/2010 |
| KR | 1020110053600 | A | 5/2011 |
| KR | 1020130109615 | A | 10/2013 |
| KR | 1020130133242 | A | 12/2013 |
| WO | 2013/006338 | A2 | 1/2013 |
| WO | 2014111765 | A1 | 7/2014 |
| WO | 2014194005 | A1 | 12/2014 |
| WO | 2016/014254 | A1 | 1/2016 |

OTHER PUBLICATIONS

Communication dated Mar. 21, 2018, issued by the European Patent Office in counterpart European application No. 15832603.3.
Communication dated May 28, 2018, issued by the State Intellectual Property Office of China in counterpart Chinese application No. 201580053026.5.

* cited by examiner

CAPTURED MICROPHONE BEAM PATTERN

REPRODUCTION LAYOUT BEAM PATTERN

[HTS USER-UX INTERACTIVE RENDERING]

METHOD AND DEVICE FOR GENERATING AND PLAYING BACK AUDIO SIGNAL

TECHNICAL FIELD

The present invention relates to a method of generating and reproducing an audio signal and an apparatus therefor, and more specifically, to a method and apparatus with improved rendering performance by collecting audio signals and reducing coherence of the collected audio signals.

The present invention also relates to a method of and an apparatus for reducing a load by reducing a computational amount, while improving the rendering performance by performing rendering based on real-time information of an audio signal.

BACKGROUND ART

To generate an audio signal, a process of capturing an audio signal through a microphone is needed. Recently, due to technological developments, capturing devices tend to be gradually miniaturized, and the necessity of use of a capturing device with a mobile device has increased.

However, the miniaturization of capturing devices leads to a gradual reduction of a distance between microphones, thereby increasing the coherence between input channels. In this case, during rendering, a degree of sound externalization for reproduction in a headphone is deteriorated, and also, the positioning performance of a sound image is deteriorated.

Therefore, a technique of reducing a system load and improving the audio signal reproduction performance regardless of capturing and rendering form factors is needed.

DETAILED DESCRIPTION OF THE INVENTION

Technical Problem

As described above, an audio generation method using a miniaturized capturing device has a problem in that the reproduction performance is deteriorated due to high coherence between input signals.

In addition, for headphone rendering, a long-tap filter should be used to simulate an echo, and thus, a computational amount increases.

In addition, in a stereophonic audio reproduction environment, head position information of a user is required to position a sound image.

The objective of the present invention is to solve the above-described problems of the prior art, to decrease signal coherence, and to improve the rendering performance by reflecting real-time head position information of a user.

Technical Solution

Representative features of the present invention to achieve the objective are as follows.

According to an aspect of an embodiment, an audio generation method includes: receiving an audio signal through at least one microphone; generating an input channel signal corresponding to each of the at least one microphone based on the received audio signal; generating a virtual input channel signal based on the input channel signal; generating additional information including reproduction locations of the input channel signal and the virtual input channel signal; and transmitting a multi-channel audio signal and the additional information, the multi-channel audio signal including the input channel signal and the virtual input channel signal.

The method may further include channel-separating the multi-channel audio signal, wherein the channel-separating includes separating channels based on coherence between channel signals included in the multi-channel audio signal and the additional information.

The transmitting may further include transmitting an object audio signal.

The additional information may further include reproduction location information of the object audio signal.

The at least one microphone may be attached to a device having a driving force.

According to an aspect of another embodiment, an audio reproduction method includes: receiving a multi-channel audio signal and additional information including a reproduction location of the multi-channel audio signal; acquiring location information of a user; channel-separating the received multi-channel audio signal based on the received additional information; rendering the channel-separated multi-channel audio signal based on the received additional information and the acquired location information of the user; and reproducing the rendered multi-channel audio signal.

The channel-separating may include separating channels based on coherence between channel signals included in the multi-channel audio signal and the additional information.

The method may further include generating a virtual input channel signal based on the received multi-channel audio signal.

The receiving may further include receiving an object audio signal.

The additional information may further include reproduction location information of the object audio signal.

The rendering of the multi-channel audio signal may include rendering the multi-channel audio signal based on a head related impulse response (HRIR) with respect to time before a predetermined reference time and rendering the multi-channel audio signal based on a binaural room impulse response (BRIR) with respect to time after the predetermined reference time.

A head related transfer function (HRTF) may be determined based on the acquired location information of the user.

The location information of the user may be determined based on a user input.

The location information of the user may be determined based on a measured head position of the user.

The location information of the user may be determined based on a head motion speed of the user and a delay of a head motion speed measurement sensor.

The head motion speed of the user includes at least one of a head angular velocity and a head moving speed.

According to an aspect of another embodiment, an audio generation apparatus includes: at least one microphone configured to receive an audio signal; an input channel signal generator configured to generate an input channel signal corresponding to each of the at least one microphone based on the received audio signal; a virtual input channel signal generator configured to generate a virtual input channel signal based on the input channel signal; an additional information generator configured to generate additional information including reproduction locations of the input channel signal and the virtual input channel signal; and a transmitter configured to transmit a multi-channel audio signal and the additional information, the multi-channel audio signal including the input channel signal and the virtual input channel signal.

According to an aspect of another embodiment, an audio reproduction apparatus includes: a receiver configured to receive a multi-channel audio signal and additional information including a reproduction location of the multi-channel audio signal; a location information acquirer configured to acquire location information of a user; a channel separator configured to channel-separate the received multi-channel audio signal based on the received additional information; a renderer configured to render the channel-separated multi-channel audio signal based on the received additional information and the acquired location information of the user; and a reproducer configured to reproduce the rendered multi-channel audio signal.

According to an aspect of another embodiment, a program for executing the methods described above and a non-transitory computer-readable recording medium having recorded thereon the program for executing the methods described above are provided.

According to an aspect of another embodiment, another method, another system, and a non-transitory computer-readable recording medium having recorded thereon a computer program for executing the method are further provided.

Advantageous Effects of the Invention

According to the present invention, the rendering performance may be improved by lowering signal coherence and reflecting real-time head position information of a user regardless of form factors and the like of a capturing device and a rendering device.

MODE OF THE INVENTION

Figure 1:
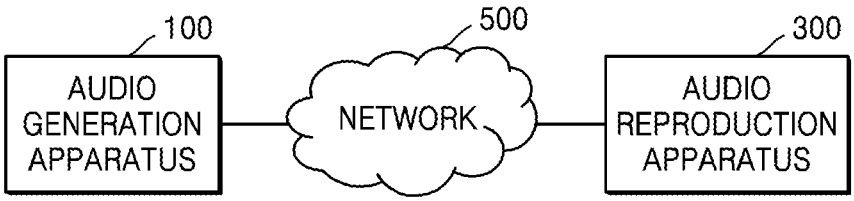
FIG. 1 is an outline diagram of a system for generating and reproducing an audio signal, according to an embodiment of the present invention.

The detailed description of the present invention to be described below refers to the accompanying drawings, in which specific embodiments by which the present invention can be carried out are shown. These embodiments are described in detail so that those of ordinary skill in the art can carry out the present invention. It should be understood that various embodiments of the present invention differ from each other but do not have to be mutually exclusive.

For example, a specific shape, structure, and characteristic described in the specification may be changed and implemented from one embodiment to another embodiment without departing from the spirit and scope of the present invention. In addition, it should be understood that locations or an arrangement of individual components in each embodiment may also be changed without departing from the spirit and scope of the present invention. Therefore, the detailed description below is not made in limitative sense, and it should be understood that the scope of the present invention include the scope claimed by the claims and all equivalent scopes.

Like reference numerals in the drawings denote like elements in various aspects. In addition, parts irrelevant to the description are omitted to clearly describe the present invention, and like reference numerals denote like elements throughout the specification.

Hereinafter, embodiments of the present invention will be described in detail with reference to the accompanying drawings so that those of ordinary skill in the art to which the present invention belongs may easily realize the present invention. However, the present invention may be embodied in many different forms and should not be construed as being limited to the embodiments set forth herein.

When it is described that a certain part is "connected" to another part, it should be understood that the certain part may be connected to another part "directly" or "electrically" via another part in the middle. In addition, when a certain part "includes" a certain component, this indicates that the part may further include another component instead of excluding another component unless there is different disclosure.

Hereinafter, the present invention is described in detail with reference to the drawings.

FIG. 1 is an outline diagram of a system for generating and reproducing an audio signal, according to an embodiment of the present invention. As shown in FIG. 1, the system for generating and reproducing an audio signal, according to an embodiment of the present invention, includes an audio generation apparatus 100, an audio reproduction apparatus 300, and a network 500.

According to the general description of a flow of an audio signal, when a sound constituting the audio signal is generated, the audio signal is transferred to a mixer through a microphone and is output to a speaker through a power amplifier. Alternatively, a process of modulating the audio signal through an effector or a process of storing the generated audio signal in a storage or reproducing the audio signal stored in the storage may be added.

Types of sound are largely classified into an acoustic sound and an electrical sound according to sources thereof. The acoustic sound such as a voice of a human being or an acoustic instrument sound needs a process of converting a sound source thereof into an electrical signal, wherein the acoustic sound is converted into an electrical signal through a microphone.

The audio generation apparatus 100 of FIG. 1 is a device for performing all the processes of generating an audio signal from a predetermined sound source.

A representative example of the sound source of the audio signal is an audio signal recorded by using a microphone. The basic principle of the microphone corresponds to a transducer for converting a form of energy from sound energy to electrical energy. The microphone generates a voltage by converting a physical, mechanical motion of air into an electrical signal and is classified into a carbon microphone, a crystal microphone, a dynamic microphone, a capacitor microphone, or the like according to a conversion scheme. For recording a sound, a capacitor microphone is mainly used.

An omnidirectional microphone has the same sensitivity for all incident angles, but a directional microphone has a difference in sensitivity according to an incident angle of an input audio signal, and this difference in sensitivity is determined depending on a unique polar pattern of the microphone. Although depending on a frequency, a unidirectional microphone most sensitively responds to a sound input from the front (0°) of the same distance and hardly detects a sound input from the rear. However, a bidirectional is most sensitive to signals input from the front (0°) and the rear (180°) and hardly detects sounds input from both sides (90° and 270°).

In this case, when an audio signal is recorded, an audio signal having a two-dimensional (2D) or 3D spatial characteristic may be recorded.

Another example of the sound source of the audio signal is an audio signal generated by using a digital sound source generation device such as a musical instrument digital interface (MIDI). The MIDI interface is equipped in a computing device and functions to connect the computing device and instrument. That is, when the computing device transmits a signal to be generated to the MIDI interface, the MIDI interface transmits signals aligned according to a predefined rule to electronic instrument to generate an audio signal. This process of collecting a sound source is called capturing.

An audio signal collected through the capturing process is encoded to a bitstream by an audio encoder. An MPEG-H audio codec standard defines an object audio signal and a higher order ambisonics (HOA) signal besides a general channel audio signal.

An object indicates each sound source constituting a sound scene, for example, indicates each instrument forming music or each of dialog, effect, and background music (BGM) constituting an audio sound of movie.

A channel audio signal includes information about a sound scene including all objects, and thus the and scene including all the objects is reproduced through an output channel (speaker). However, an object signal stores, transmits, and reproduces a signal on an object unit basis, and thus a reproducer may independently reproduce each object through object rendering.

When an object-oriented signal processing and encoding technique is applied, each of objects constituting a sound scene may be extracted and reconfigured according to circumstances. As an example of an audio sound of music, general music content is obtained by individually recording each instrument forming music and appropriately mixing tracks of respective instruments through a mixing process. If a track of each instrument is configured as an object, a user may control each object (instrument) independently, and thus the user may adjust a sound magnitude of a specific object (instrument) and change a spatial location of the object (instrument).

As an example of an audio sound of movie, the movie has the possibility of being reproduced in various countries, and sound effects and BGM are irrelevant to the countries, but dialog needs to be reproduced in a language desired by the user. Therefore, dialog audio sounds dubbed to languages of various countries, such as Korean, Japanese, and English, may be processed as objects and included in the audio signal. In this case, when the user selects Korean as a language desired by the user, an object corresponding to Korean is selected and included in the audio signal, such that Korean dialog is reproduced.

The MPEG-H standard defines HOA as a new input signal, and according to HOA, a sound scene may be represented in a form different from an existing channel or object audio signal by using a specially produced microphone and a special storage method representing the microphone in a series of processes of acquiring an audio signal through the microphone and reproducing the audio signal again.

An audio signal captured as described above is encoded by an audio signal encoder and transmitted in a form of bitstream. As described above, a form of final output data of an encoder is a bitstream, and thus an input of a decoder is also a bitstream.

The audio reproduction apparatus 300 receives a bitstream transmitted via the network 500 and restores a channel audio signal, an object audio signal, and HOA by decoding the received bitstream.

The restored audio signals may be output as a multi-channel audio signal nixed with a plurality of output channels by which a plurality of input channels are to be reproduced through rendering. In this case, when a number of the output channels is less than a number of the input channels, the input channels are down-mixed to meet the number of the output channels.

Stereophonic audio indicates audio additionally having spatial information allowing a user to feel presence by reproducing not only a pitch and tone of a sound but also a direction and a sense of distance and allowing a user who is not located in a space from which the sound is generated to recognize a sense of direction, a sense of distance, and a sense of space.

In the description below, output channels of an audio signal may indicate a number of speakers through which audio is output. The more a number of output channels, the more a number of speakers through which audio is output. The stereophonic audio reproduction apparatus 100 according to an embodiment may render and mix a multi-channel audio input signal to output channels to be reproduced such that the multi-channel audio input signal having a many number of input channels is output and reproduced in an environment with a small number of output channels. In this case, the multi-channel audio input signal may include a channel capable of outputting an elevated sound.

The channel capable of outputting the elevated sound may indicate a channel capable of outputting an audio signal through a speaker located on the head of the user such that the user can feel a sense of elevation. A horizontal channel may indicate a channel capable of outputting an audio signal through a speaker located on a plane horizontal to the user.

The above-described environment with a small number of output channels may indicate an environment in which audio can be output through speakers arranged on a horizontal plane without including an output channel capable of outputting an elevated sound.

In addition, in the description below, a horizontal channel may indicate a channel including an audio signal which can be output through a speaker arranged on a horizontal plane. An overhead channel may indicate a channel including an audio signal which can be output through a speaker arranged at an elevated place instead of the horizontal plane and capable of outputting an elevated sound.

The network 500 functions to connect the audio generation apparatus 100 and the audio reproduction apparatus 300. That is, the network 500 indicates a communication network for providing a connection path through which data can be transmitted and received. The network 500 according to an embodiment of the present invention may be configured regardless of communication aspects such as wired communication and wireless communication and may be configured by a local area network (LAN), a metropolitan area network (MAN), and a wide area network (WAN), taken alone or in combination.

The network 500 is a compressive data communication network enabling the network component entities shown in FIG. 1 to smoothly communicate with each other and may include at least some of a wired Internet, a wireless Internet, a mobile wireless communication network, a telephone network and a wired/wireless television communication network.

The first step of a process of generating an audio signal is to capture the audio signal. The capturing of the audio signal includes collecting audio signals having spatial location information in the entire azimuth range of 360° in a 2D or 3D space.

An audio signal capturing environment can be largely divided into a studio environment and an environment using a capturing device having a relatively small-sized form factor. An example of audio content produced in the studio environment is as follows.

A most general audio signal capture system is a system for recording sound sources through microphones in the studio environment and mixing the recorded sound sources to generate audio content. Alternatively, sound sources captured by using microphones installed in various places in an indoor environment such as a stage may be mixed in a studio to generate content. Particularly, this method is usually applied to classic music recording. In the past, a two-track recording method of a stereo output without performing post mixing production was used, but recently, a multi-track (channel) recording method is used to perform post mixing production or multi-channel (5.1-channel or the like) surround mixing.

Alternatively, there is an audio post production work of inflicting a sound on image data such as movie, broadcast, advertisement, game, or animation. In case of movie as a representative example, there are music, dialog, and sound effect works and a final mixing work for finally mixing music, dialog, and sound effects.

The audio content captured un the studio environment is the best in terms of sound quality, but the studio environment can be used only in a limited environment and at a limited time, and there require a lot of installation and maintenance costs.

Along with the development of integrated circuit technology and the development of 3D audio technology, a form factor of an audio capturing device tends to be miniaturized. Recently, an audio capturing form factor having a size of tens Cm has been used, and an audio capturing form factor having a size of several Cm also has been developed. A 20-Cm-sized form factor is usually used for audio content binaural-rendered and reproduced through headphones or the like. a capturing device having a smaller-sized form factor may be implemented by using a directional microphone.

As a size of a form factor of an audio signal capturing device is small, portability is enhanced, and an access of a used is easy, and thus the usability of the audio signal capturing device may increase. Representatively, an operation of capturing an audio signal and then being linked to a portable device to mix, edit, and reproduce the captured audio signal may be possible.

However, when a size of a form factor is small, the usability of audio signal capturing device is good, but a distance between microphones is short, and thus coherence between capturing signals input to different microphones increases.

FIG. 2 illustrates a phenomenon of increasing coherence between input channels in an audio generation apparatus according to an embodiment of the present invention and an influence to the rendering performance.

Figure 2A:
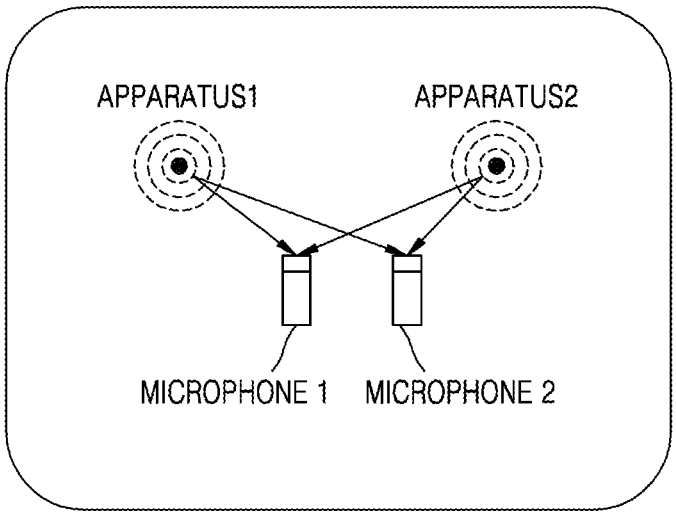
FIG. 2A illustrates a phenomenon of increasing coherence between input channel signals in an audio generation apparatus according to an embodiment of the present invention.

FIG. 2A illustrates a phenomenon of increasing coherence between input channel signals in an audio generation apparatus according to an embodiment of the present invention.

The embodiment of FIG. 2A assumes a case of two microphones, that is, two input channels.

An audio signal received through a microphone has a unique signal characteristic according to a relationship between a location of a sound image and a location of the microphone for receiving the sound image. Therefore, when audio signals are received through a plurality of microphones, locations (distances, azimuth angles, and elevation angles) of sound images may be detected by analyzing a time delay, a phase, and a frequency characteristic of an audio signal received through each of the microphones.

However, even when audio signals are received through a plurality of microphones, if a distance between the microphones is short, characteristics of the audio signals received through the respective microphones become similar. Therefore, since the characteristics of the audio signals, i.e., input channel signals, received through the respective microphones are similar, coherence between the input channel signals increases.

This phenomenon is severer as a distance between the microphones is shorter, thereby increasing the coherence between the input channel signals more. In addition, when the coherence between the input channel signals is high, the rendering performance is deteriorated, thereby affecting the reproduction performance.

Figure 2B:
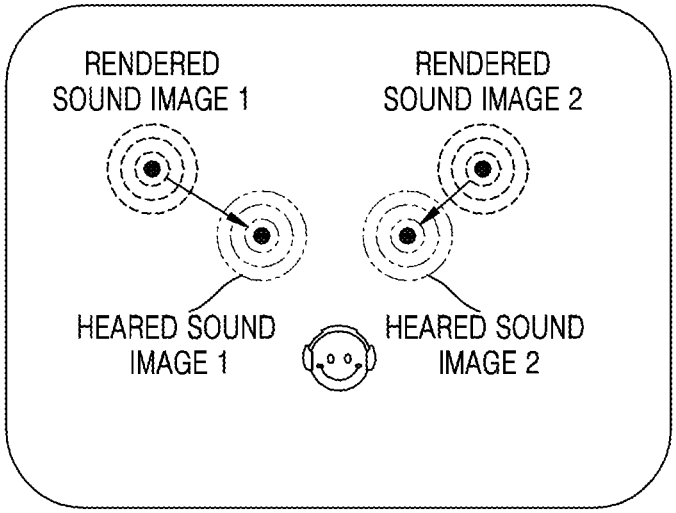
FIG. 2B illustrates a phenomenon of deteriorating the rendering performance when coherence between input channel signals is high in an audio reproduction apparatus according to an embodiment of the present invention.

FIG. 2B illustrates a phenomenon of deteriorating the rendering performance when coherence between input channel signals is high in an audio reproduction apparatus according to an embodiment of the present invention.

In case of headphones as an example, when a user listens to an audio signal by using headphones or the like, if a sound image is focused on the inside of the head, that is, if a sound internalization phenomenon occurs, the user may feel tiredness when listening the audio signal for a long time. Therefore, in a listening environment using headphones or the like, externalization of a sound image through rendering using a binaural room transfer function (BRTF) is an important technical problem. In this case, the BRTF is a term in a frequency domain and is represented as a binaural room impulse response (BRIR) in a time domain.

However, when the coherence between the input channel signals is high, the rendering performance is deteriorated, and thus a sound externalization effect in a listening environment using headphones is reduced.

In case of a general listening environment instead of headphones as an example, in order for a user to listen to an audio signal by using a home theater system (HTS) or the like, positioning a sound image at an appropriate location is an important technical problem. Therefore, an input signal is panned according to a relationship between an input channel and an output channel, and a sound image is positioned through rendering using a head related transfer function (HRTF). In this case, the HRTF is also a term in the frequency domain and is represented as a head related impulse response (HRIR) in time domain.

However, when the coherence between the input channel signals is high, the rendering performance is deteriorated, and thus it is difficult to position a sound image at an appropriate location.

Therefore, to prevent the deterioration of the rendering performance according to the increase in the coherence between the input channel signals, processing of reducing the coherence between the input channel signals is needed.

Figure 3:
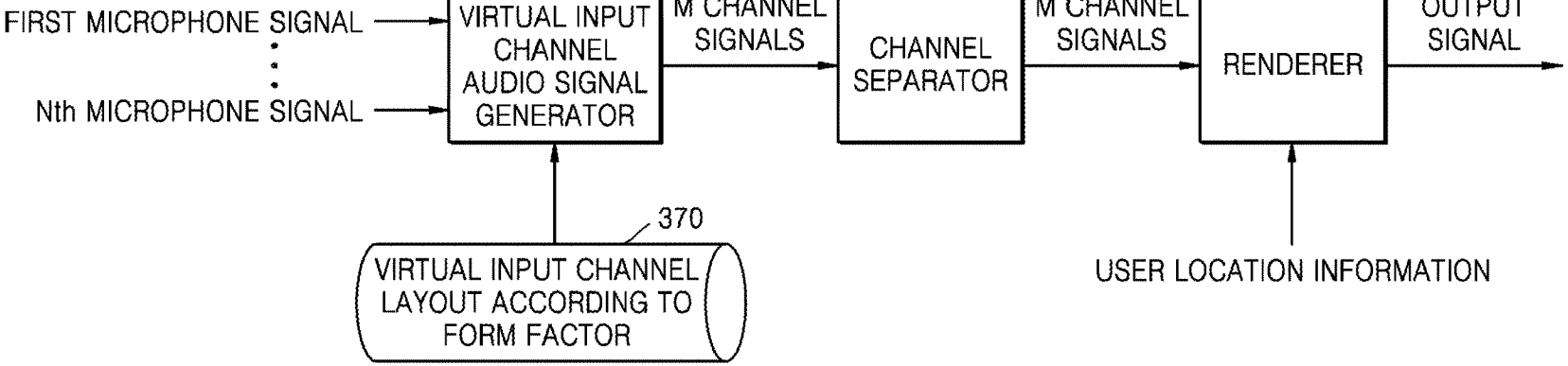
FIG. 3 is a block diagram of a system for generating and reproducing an audio signal, according to an embodiment of the present invention.

FIG. 3 is a block diagram of a system for generating and reproducing an audio signal, according to an embodiment of the present invention.

In the embodiment disclosed in FIG. 3, a system 300 for generating and reproducing an audio signal includes a virtual input channel audio signal generator 310, a channel separator 330, and a renderer 350.

The virtual input channel audio signal generator 310 generates N virtual input channel audio signals by using N input channel audio signals input through N microphones.

In this case, a virtual input channel layout which can be generated may vary according to a form factor of an audio signal capturer. According to an embodiment of the present invention, a virtual input channel layout to be generated may be manually set by a user. According to another embodiment of the present invention, a virtual input channel layout to be generated may be determined based on a virtual input channel layout according to a form factor of a capturing device and may refer to a database stored in a storage.

If an actual input channel layout is the same as a virtual channel layout, a virtual channel signal may be replaced by an actual input channel signal. Signals output from the virtual input channel audio signal generator 310 are M input channel audio signals including virtual input channel audio signals, wherein M is an integer greater than N.

The channel separator 330 channel-separates the M input channel audio signals transmitted from the virtual input channel audio signal generator. For the channel separation, a process of calculating coherences through signal processing for each frequency band and reducing high coherence of a signal having the high coherence is performed. The channel separation will be described in more detail below.

The renderer 350 includes a filtering unit (not shown) and a panning unit (not shown).

The panning unit calculates and applies a panning coefficient to be applied for each frequency band and each channel in order to pan an input audio signal with respect to each output channel. The panning on an audio signal indicates controlling a magnitude of a signal to be applied to each output channel in order to render a sound source to a specific location between two output channels. The panning coefficient may be replaced by the term "panning gain".

The panning unit may render a low frequency signal of an overhead channel signal according to an add-to-the-closest-channel method and render a high frequency signal according to a multi-channel panning method. According to the multi-channel panning method, a gain value differently set for a channel to be rendered to each channel signal is applied to a signal of each channel of a multi-channel audio signal, and thus the signal of each channel of the multi-channel audio signal may be rendered to at least one horizontal channel. Signals of channels to which gain values have been applied may be added through mixing, thereby outputting a final signal.

Since a low frequency signal has a strong diffractive property, even when each channel of the multi-channel audio signal is rendered to only one channel instead of rendered to each of several channels according to the multi-channel panning method, a final output signal may have sound quality similar to that of an output signal obtained by rendering the channels of the multi-channel audio signal to several channels when the user listen to the final output signal. Therefore, the audio reproduction apparatus 300 reproducing stereophonic audio according to an embodiment may prevent sound quality deterioration which may occur according to mixing several channels to one output channel, by rendering a low frequency signal according to the add-to-the-closest-channel method. That is, when several channels are missed to one channel, sound quality may be deteriorated due to amplification or cut-off according to interference between channel signals, and thus the deterioration of sound quality may be prevented by mixing one channel to one output channel.

According to the add-to-the-closest-channel method, each channel of a multi-channel audio signal may be rendered to the closest channel among channels to be reproduced instead of separately rendered to several channels.

The filtering unit may correct a tone and the like of a decoded audio signal according to a location and filter an input audio signal by using a HRTF filter.

The filtering unit may render an overhead channel which has passed through the HRTF filter for 3D rendering of the overhead channel, by a different method according to a frequency.

The HRTF filter enables the user to recognize stereophonic audio by not only simple path differences such as a level difference between two ears (inter-aural level difference (ILD)) and an audio arrival time difference between two ears (inter-aural time difference (ITD)) but also a phenomenon in which complicated path characteristics such as diffraction on a head surface and reflection from an auricle vary according to a sound arrival direction. The HRTF filter may process audio signals included in an overhead channel by changing sound quality of the audio signals such that stereophonic audio can be recognized.

Hereinafter, operations of the virtual input channel audio signal generator 310, the channel separator 330, and the renderer 350 will be described in more detail with reference to FIGS. 4 through 7.

FIG. 4 illustrates an operation of a virtual input channel audio signal generator according to an embodiment of the present invention.

Figure 4A:
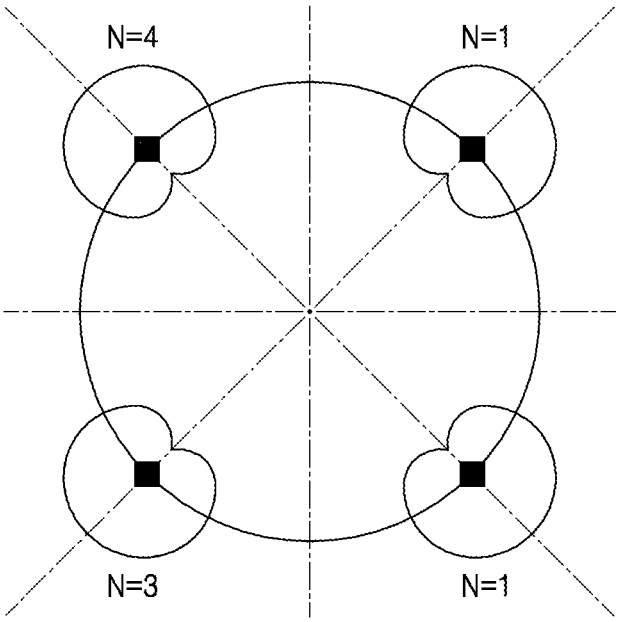
FIG. 4A illustrates captured audio signals in an audio reproduction apparatus according to an embodiment of the present invention.

According to the embodiment disclosed in FIG. 4A, an audio generation apparatus captures audio signals by using four microphones having the same distance from the center and having an angle of 90° therebetween. Therefore, in the embodiment disclosed in FIG. 4A, a number N of input channels is 4. In this case, the used microphones are directional microphones having a cardioids pattern, and a cardioids microphone has a characteristic that side sensitivity is lower by 6 dB than front sensitivity and rear sensitivity is almost 0.

Since the four microphones have the same distance from the center and have an angle of 90° therebetween, a beam pattern of four channel input audio signals captured in this environment is as shown in FIG. 4A.

Figure 4B:
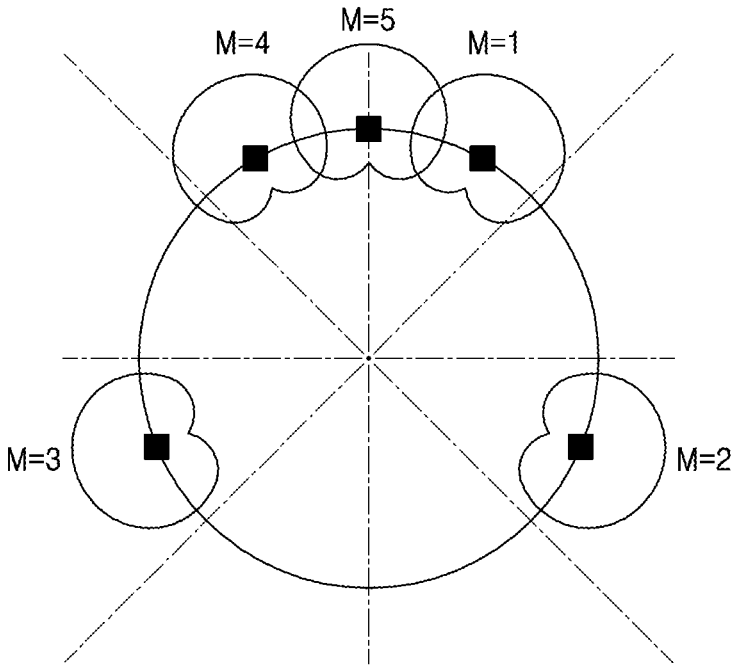
FIG. 4B illustrates audio signals including a virtual input channel signal according to an embodiment of the present invention.

FIG. 4B illustrates five input channel audio signals including a virtual microphone signal, i.e., a virtual input channel audio signal, generated based on the captured four input channel audio signals of FIG. 4A. That is, in the embodiment disclosed in FIG. 4B, a number M of virtual input channels is 5.

According to the embodiment disclosed in FIG. 4B, the virtual microphone signal is generated by weighted-summing the four channel input signals captured by the four microphones. In this case, weights to be applied to the weighted sum are determined based on a layout of input channels and a reproduction layout.

As a result of the weighted sum of the four input channel signals having the beam pattern as shown in FIG. 4A, a front right channel (M=1), a surround right channel (M=2), a surround left channel (M=3), a front right channel (M=4), and a center channel (M=5) may be configured to meet a 5.1-channel layout as shown in FIG. 4B (an woofer channel is not shown).

Figure 5:
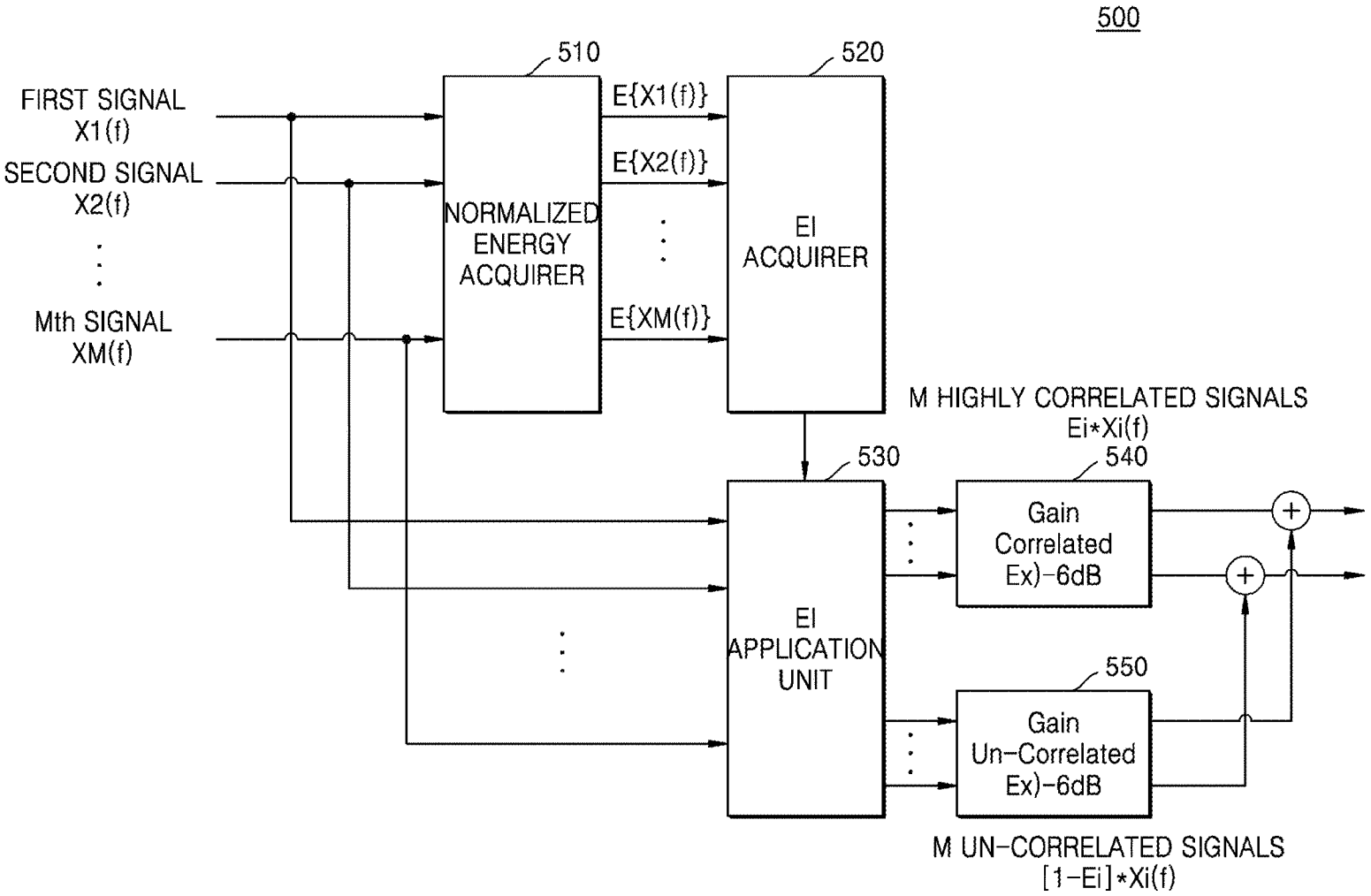
FIG. 5 is a detailed block diagram of a channel separator according to an embodiment of the present invention.

FIG. 5 is a detailed block diagram of a channel separator according to an embodiment of the present invention.

A channel separator 500 according to the embodiment disclosed in FIG. 5 includes a normalized energy acquirer 510, an energy index (EI) acquirer 520, an EI application unit 530, and gain application units 540 and 550.

The normalized energy acquirer 510 receives M input channel signals $X_1(f)$, $X_2(f)$, . . . , $X_M(f)$ and acquires normalized energy $E\{X_1(f)\}$, $E\{X_2(f)\}$, . . . , $E\{X_M(f)\}$ for each frequency band of each input channel signal. In this case, normalized energy $E\{X_i(f)\}$ of each input channel signal is determined by Equation 1.

$$E(X_1(f)) = \frac{|X_1(f)|^2}{|X_1(f)|^2 + |X_2(f)|^2 + \cdots + |X_M(f)|^2} \tag{1}$$

That is, the normalized energy $E\{X_i(f)\}$ of each input channel signal corresponds to a ratio of energy occupied by an $i^{th}$ input channel signal in a corresponding frequency band to that of all the input channel signals.

The EI acquirer 520 acquires an index of a channel having the greatest energy among all the channels by calculating energy for each frequency band for each channel. In this case, an energy index EI is determined by Equation 2.

$$EI(f)=N/(N-1)\times[1-\max(E\{X_1(f)\},E\{(X_2(f)\},\ldots,E\{X_M(f)\})] \tag{2}$$

The EI application unit 530 generates M highly correlated channel signals and M un-correlated signals based on a predetermined threshold. The gain application unit 540 multiplies the highly correlated signals received from the EI application unit 530 by a gain Ei and the gain application unit 550 multiplies the un-correlated signals received from the EI application unit by a gain (1−Ei), respectively.

Thereafter, the M highly correlated channel signals and the M un-correlated signals to which the gains have been reflected are added to reduce channel coherence, thereby improving the rendering performance.

Figure 6:
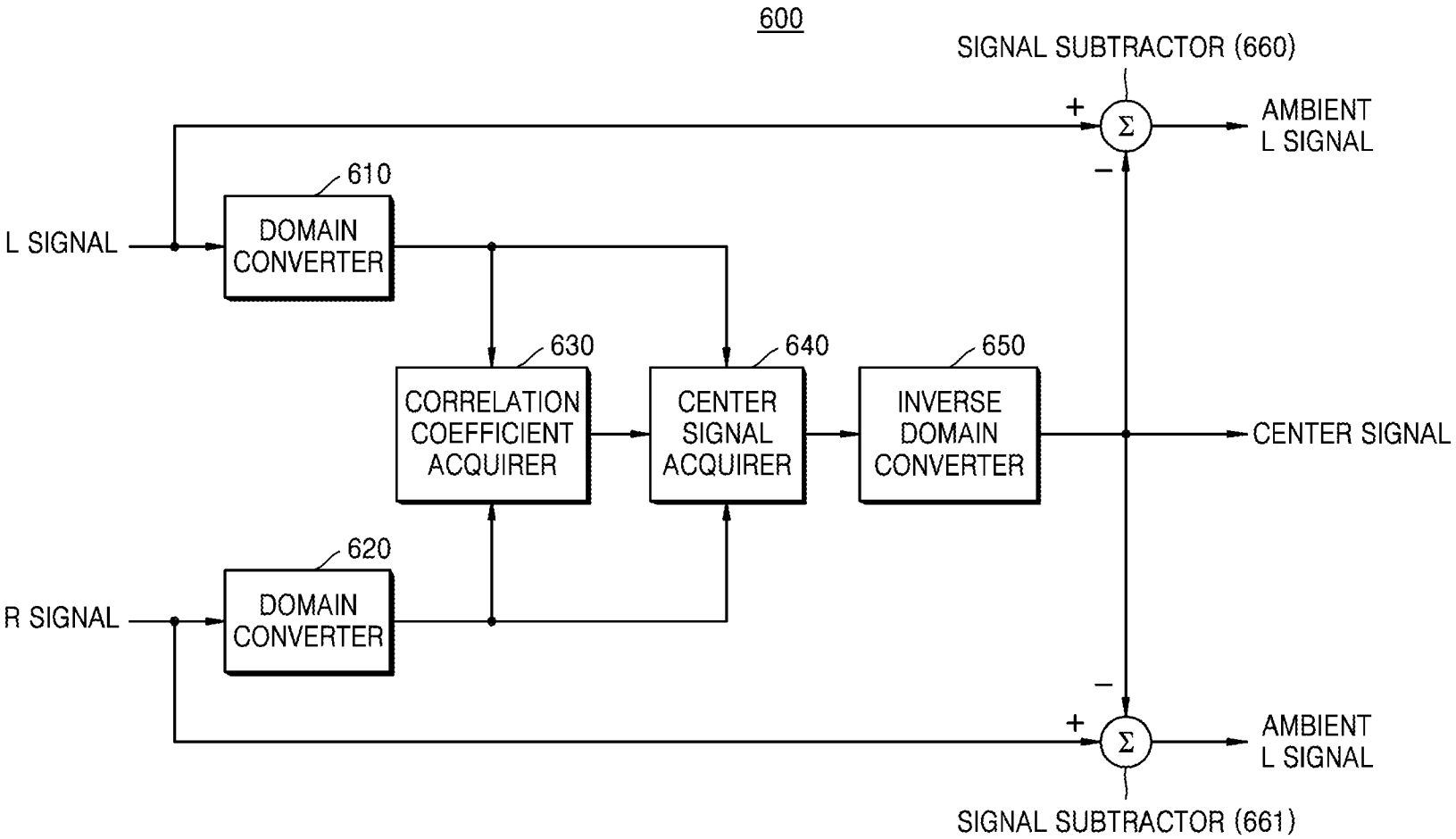
FIG. 6 is a block diagram of a configuration in which the virtual input channel signal generator and the channel separator are integrated, according to an embodiment of the present invention.

FIG. 6 is a block diagram of a configuration in which the virtual input channel signal generator and the channel separator are integrated, according to an embodiment of the present invention.

FIG. 6 is a block diagram for describing a method of using a center signal separation technique to separate sound images of three locations for two different input signals.

In detail, the embodiment disclosed in FIG. 6 is an embodiment of generating a virtual center (C) input channel signal from left (FL) and right (FR) input channel signals and channel-separating left, center, and right input channel signals. Referring to FIG. 6, a sound image separator 600 includes domain converters 610 and 620, a correlation coefficient acquirer 630, a center signal acquirer 640, an inverse domain converter 650, and signal substractors 660 and 661.

Even though a sound is generated by the same sound source, a collected signal may vary according to a location of a microphone. In general, since a sound source for generating a voice signal, such as a singer or an announcer, is located at the center of a stage, stereo signals generated based on the voice signal generated from the sound source located at the center of the stage include same left and right signals. However, when a sound source is not located at the center of a stage, even for a signal generated by the same sound source, since there occurs a difference between strengths and arrival times of sounds arriving at two microphones, signals collected by the microphones differ from each other, and thus left and right stereo signals also differ from each other.

In the present specification, a signal commonly included in stereo signals as well as a voice signal is defined as a center signal, and signals obtained by subtracting the center signal from the stereo signals are referred to as ambient stereo signals (ambient left and ambient right signals).

The domain converters 610 and 620 receive stereo signals L and R. The domain converters 610 and 620 convert a domain of the received stereo signals. The domain converters 610 and 620 convert the stereo signals to stereo signals in a time-frequency domain by using an algorithm such as fast Fourier transform (FFT). The time-frequency domain is used to represent both changes in time and frequency. A signal may be divided into a plurality of frames according to time and frequency values, and a signal in each frame may be represented by a frequency sub-band value in each time slot.

The correlation coefficient acquirer 630 calculates a correlation coefficient by using the stereo signals converted to the time-frequency domain by the domain converters 610 and 620. The correlation coefficient acquirer 630 calculates a first coefficient indicating coherence between the stereo signals and a second coefficient indicating similarity between the two signals and calculates the correlation coefficient by using the first coefficient and the second coefficient.

The coherence between two signals indicates a correlated degree of the two signals, and the first coefficient in the time-frequency domain may be represented by Equation 3.

$$\phi(n, k) = \frac{|\phi_{12}(n, k)|}{\sqrt{\phi_{11}(n, k)\phi_{22}(n, k)}} \tag{3}$$

where n denotes a time value, that is, a time slot value, and k denotes a frequency band value. The denominator of Equation 1 is a factor for normalizing the first coefficient. The first coefficient has a real number value greater than or equal to 0 and less than or equal to 1.

In Equation 3, $\varphi_{ij}$(n,k) may be obtained as in Equation 4 by using an expectation function.

$$\phi ij(n,k)=E[X_iX_j^*] \tag{4}$$

where $X_i$ and $X_j$ denote stereo signals represented by a complex number in the time-frequency domain, and $X_j^*$ denotes a conjugate complex number of $X_j$.

The expectation function is a probability statics function used to obtain an average value of current signals by taking into account past values of the signals. Therefore, when a product of $X_i$ and $X_j^*$ is applied to the expectation function, coherence between two current signals $X_i$ and $X_j$ is obtained by taking into account a statics value of coherence between two past signals $X_i$ and $X_j$. Since Equation 4 requires a lot of computation amount, an approximate value of Equation 4 may be obtained by using Equation 5.

$$\phi ij(n,k)=(1-\lambda)\phi ij(n-1,k)+\lambda X_i(n,k)X_j^*(n,k) \tag{5}$$

In Equation 5, a first term indicates coherence of stereo signals in a frame immediately before a current frame, i.e., a frame having an $(n-1)^{th}$ time slot value and a $k^{th}$ frequency band value. That is, Equation 5 indicates that coherence of signals in a past frame before a current frame is considered when coherence of signals in the current frame is considered, and this is represented by using a probability statics function to predict coherence between current stereo signals as a probability based on statics, coherence between past stereo signals.

In Equation 5, constants $1-\lambda$ and $\lambda$ are multiplied in terms, respectively, and these constants are used to grant constant weights to a past average value and a current value, respectively. A large value of the constant $1-\lambda$ granted to the first term indicates that a current signal is largely affected from the past.

The correlation coefficient acquirer 630 obtains Equation 3 by using Equation 4 or 5. The correlation coefficient acquirer 630 calculates the first coefficient indicating coherence between two signals by using Equation 3.

The correlation coefficient acquirer 630 calculates the second coefficient indicating similarity between two signals. The second coefficient indicates a degree of similarity between two signals, and the second coefficient in the time-frequency domain may be represented by Equation 6.

$$\psi(n, k) = \frac{\lambda\,|\psi_{12}(n, k)|}{\psi_{11}(n, k) + \psi_{22}(n, k)} \tag{6}$$

where n denotes a time value, that is, a time slot value, and k denotes a frequency band value. The denominator of Equation 6 is a factor for normalizing the first coefficient. The second coefficient has a real number value greater than or equal to 0 and less than or equal to 1.

In Equation 6, Ψij(n,k) may be represented by Equation 7.

$$\Psi_{ij}(n,k)=X_i(n,k)X_j^*(n,k) \tag{7}$$

where $X_i$ and $X_j$ denote stereo signals represented by a complex number in the time-frequency domain, and $X_j^*$ denotes a conjugate complex number of $X_j$.

Unlike considering a past signal value by using a probability statics function when the first coefficient is obtained in Equation 4 or 5, in Equation 7, a past signal value is not considered when Ψij(n,k) is obtained. That is, the correlation coefficient acquirer 730 considers only similarity between two signals in a current frame when considering the similarity between the two signals.

The correlation coefficient acquirer 630 obtains Equation 6 by using Equation 7 and obtains the second coefficient by using Equation 6.

Obtaining coherence between two signals by using Equation 5, and obtaining similarity between the two signals by using Equation 6 are disclosed in Journal of Audio Engineering Society, Vol. 52, No. 7/8, 2004 July/August "A frequency-domain approach to multichannel upmix", Author Carlos Avendano.

The correlation coefficient acquirer 730 obtains a correlation coefficient Δ by using the first coefficient and the second coefficient. The correlation coefficient Δ is obtained by using Equation 8.

$$\Delta(n,k)=\phi(n,k)\Psi(n,k) \tag{8}$$

As shown in Equation 8, a correlation coefficient in the present invention is a value obtained by considering both similarity and coherence between two signals. Since both the first coefficient and the second coefficient are real numbers greater than or equal to 0 and less than or equal to 1, the correlation coefficient also has a real number value greater than or equal to 0 and less than or equal to 1.

The correlation coefficient acquirer 630 obtains a correlation coefficient and transmits the obtained correlation coefficient to the center signal acquirer 640. The center signal acquirer 640 extracts a center signal from the stereo signals by using the correlation coefficient and the stereo signals. The center signal acquirer 640 generates the center signal by obtaining an arithmetic average of the stereo signals and multiplying the arithmetic average by the correlation coefficient. The center signal obtained by the center signal acquirer 640 may be represented by Equation 9.

$$C(n, k) = \Delta(n, k) \times \frac{(X_1(n, k) + X_{2(n,k)})}{2} \tag{9}$$

where $X_2(n,k)$ and $X_2(n,k)$ denote a left signal and a right signal in a frame having a time value of n and a frequency value of k, respectively.

The center signal acquirer 640 transmits the center signal generated as in Equation 9 to the inverse domain converter 650. The inverse domain converter 650 converts the center signal generated in the time-frequency domain into a center signal in the time domain by using an algorithm such as inverse FFT (IFFT). The inverse domain converter 650 transmits the center signal converted into the time domain to the signal substractors 660 and 661.

The signal substractors 660 and 661 obtain differences between the stereo signals and the center signal in the time domain. The signal substractors 660 and 661 obtain an ambient left signal by subtracting the center signal from the left signal and generate an ambient right signal by subtracting the center signal from the right signal.

As described above, according to an embodiment of the present invention, the correlation coefficient acquirer 630 obtains a first coefficient indicating coherence between a left signal and a right signal at a current time point in consideration of past coherence between the two signals and obtains a second coefficient indicating similarity between the left signal and the right signal at the current time point. In addition, according to an embodiment of the present invention, the correlation coefficient acquirer 630 generates a correlation coefficient by using both the first coefficient and the second coefficient and extracts a center signal from stereo signals by using the correlation coefficient. In addition, according to an embodiment of the present invention, since the correlation coefficient is obtained in the time-frequency domain instead of the time domain, the correlation coefficient may be obtained more precisely in consideration of both time and frequency than in consideration of time only.

When a number of input channels is greater than two channels, input channel signals may be bound on a two-channel basis, and a center channel signal separation technique may be applied to the input channel signals a plurality of times, or input channels may be down-mixed, and then a center channel separation technique may be applied to the down-mixed input channels to perform channel separation to a plurality of locations.

Figure 7:
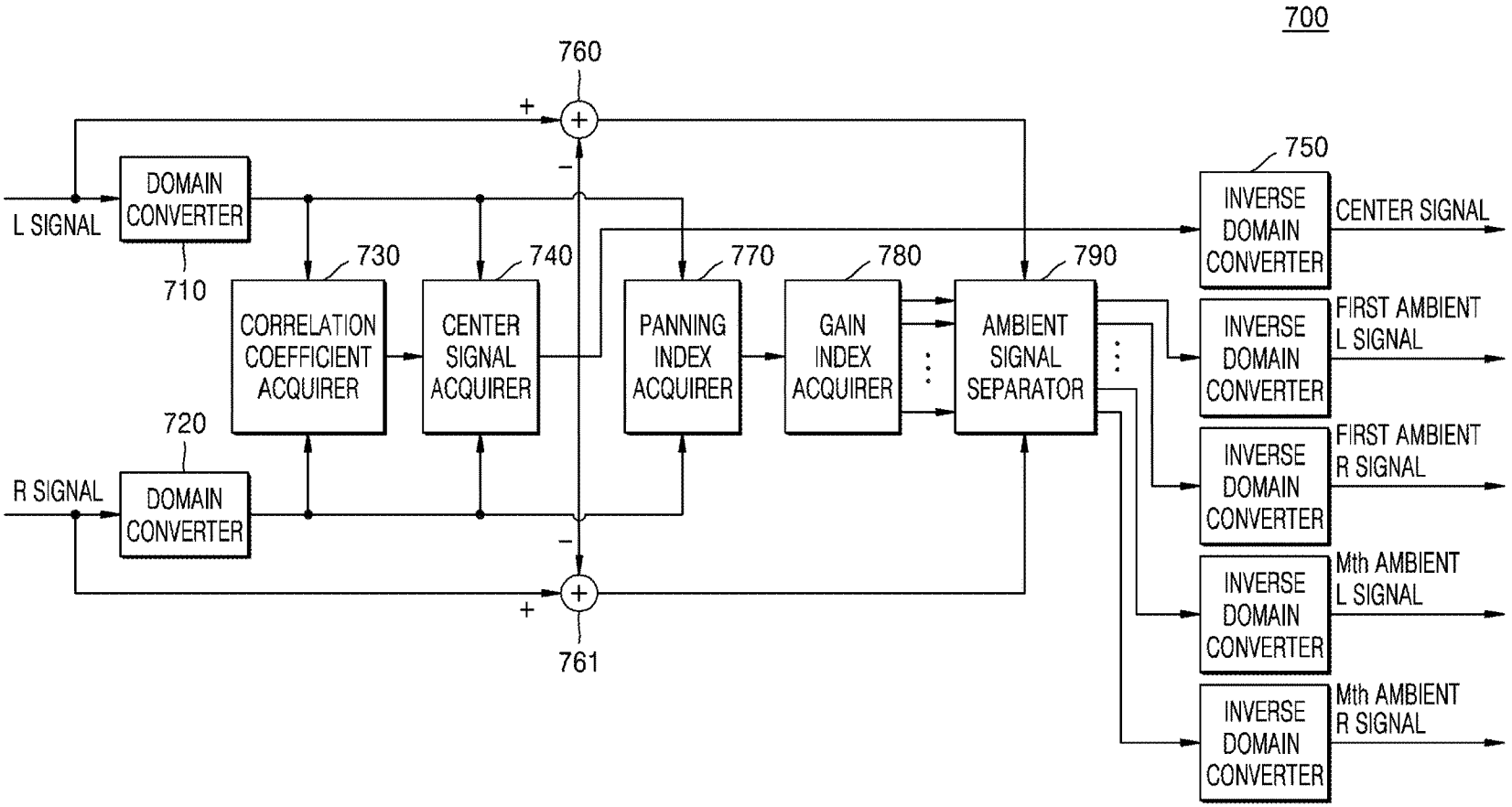
FIG. 7 is a block diagram of a configuration in which the virtual input channel signal generator and the channel separator are integrated, according to another embodiment of the present invention.

FIG. 7 is a block diagram of a configuration in which the virtual input channel signal generator and the channel separator are integrated, according to another embodiment of the present invention.

Referring to FIG. 7, a sound image separator 700 includes domain converters 710 and 720, a correlation coefficient acquirer 730, a center signal acquirer 740, an inverse domain converter 750, signal substractors 760 and 761, a panning index acquirer 770, a gain index acquirer 780, and an ambient signal separator 790.

The embodiment disclosed in FIG. 7 assumes that sound image separation to N different sound image locations is performed for two different input signals. As well as the embodiment shown in FIG. 6, in the embodiment shown in FIG. 7, when a number of input channels is greater than two channels, input channel signals may also be bound on a two-channel basis, and a center channel signal separation technique may be applied to the input channel signals a plurality of times, or input channels may also be down-mixed, and then a center channel separation technique may be applied to the down-mixed input channels to perform channel separation to a plurality of locations.

A process of acquiring a center signal from stereo signals L and R is the same as that in the embodiment disclosed in FIG. 7.

The panning index acquirer 770 acquires a panning index $\text{Pan_Index}_{ij}(n,k)$ for separating a two-channel ambient signal into a 2×N-channel ambient signal to extract the center signal. The panning index is determined by Equation 10.

$$\text{Pan_Index}_{ij}(n, k) = \frac{\phi_{ii}(n, k) - \phi_{jj}(n, k)}{\phi_{ii}(n, k) + \phi_{jj}(n, k)} \tag{10}$$

where $\varphi_{ij}(n,k)$ is determined by Equations 3 and 4, and $\text{Pan_Index}_{ij}(n,k)$ has a range between −1 and 1.

The gain index acquirer 780 acquires each gain index $\Delta_1(n,k)$ to be applied to a sound image of an $I^{th}$ location by substituting the panning index to a predetermined gain table. The gain index is determined by Equation 11.

$$\begin{bmatrix} \Delta_1(n, k) \\ \vdots \\ \Delta_N(n, k) \end{bmatrix} = \text{Gain_Table}(\text{Pan_Index}_{ij}(n, k)) \tag{11}$$

The ambient signal separator 790 acquires an ambient signal at the $I^{th}$ location based on frequency domain signals of L and R ambient signals and the gain index. A gain to be applied to the ambient signal and the acquired L and R ambient signals at the $I^{th}$ location are determined by Equations 12 and 13, and $\lambda_C$ is a forgetting factor and has a value between 0 and 1.

$$\text{Gain}_1(n, k) = (1 - \lambda_G)\Delta_1(n - 1, k) + \lambda_G\Delta_1(n, k) \tag{12}$$

$$\begin{cases} X_{1L}(n, k) = \text{Gain}_1(n, k)(X_L(n, k) - C(n, k)) \\ X_{1R}(n, k) = \text{Gain}_1(n, k)(X_R(n, k) - C(n, k)) \end{cases} \tag{13}$$

where $X_{IL}(n,k)$ and $X_{IR}(n,k)$ denote frequency domain L and R ambient signals at the $I^{th}$ location, which have been sound-image-separated and finally acquired from the L and R ambient signals, respectively.

2×N ambient signals acquired in the manner described above are transmitted to the inverse domain converter 750, and the inverse domain converter 750 converts the center signal and the 2×N ambient signals into a center signal and 2×N ambient signals in the time domain by using an algorithm such as IFFT. As a result of the inverse domain conversion, a time domain signal separated into 2×N+1 channels in the time domain may be acquired.

Although only a case of two input channels, i.e., a stereo input, has been described with reference to FIGS. 6 and 7, the same algorithm may be applied to cases of a more number of input channels.

FIG. 8 shows a flowchart of a method of generating audio and a flowchart of a method of reproducing audio, according to an embodiment of the present invention. The embodiment disclosed in FIG. 8 assumes that the above-described process of generating a virtual channel and channel-separating a sound image is performed by an audio reproduction apparatus.

Figure 8A:
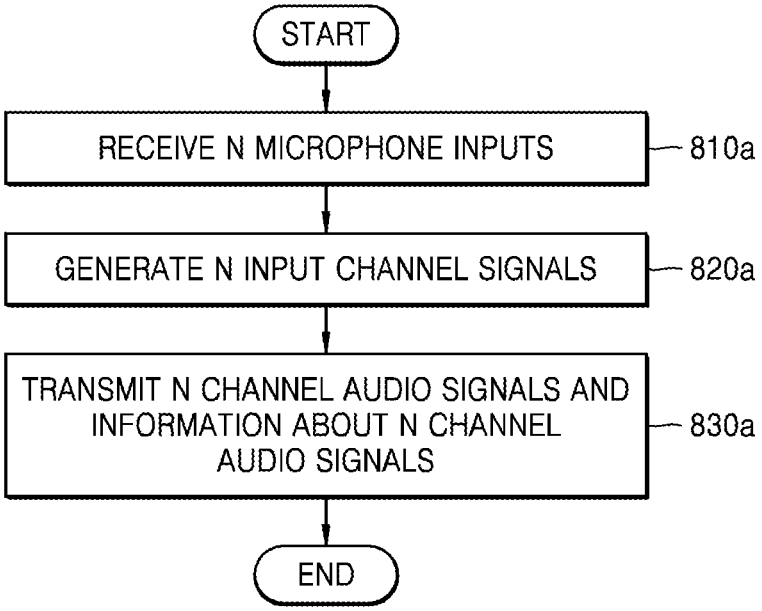
FIG. 8A show a flowchart of a method of generating audio according to an embodiment of the present.

FIG. 8A is a flowchart of a method of generating audio, according to an embodiment of the present invention.

The audio generation apparatus 100 according to the embodiment disclosed in FIG. 8A receives input audio signals from N microphones in operation 810*a* and generates N input channel signals corresponding to the signals received from the respective microphones in operation 820*a*.

Since virtual channel generation and sound image separation are performed by the audio reproduction apparatus 300, the audio generation apparatus 100 transmits generated N channel audio signals and information about the N channel audio signals to the audio reproduction apparatus 300 in operation 830*a*. In this case, the audio signals and the information about the audio signals are encoded to a bitstream based on an appropriate codec and transmitted, and the information about the audio signals may be configured as metadata defined by the codec and encoded to a bitstream.

If the codec supports an object audio signal, the audio signal may include an object audio signal. Herein, the information about the N channel audio signals may include information about a location at which each channel signal is to be reproduced, and in this case, the information about a location at which each channel signal is to be reproduced may vary along time.

For example, when birdsong is implemented as an object audio signal, a location at which the birdsong is to be reproduced varies along a path through which a bird moves, and thus a location at which a channel signal is to be reproduced varies along time.

Figure 8B:
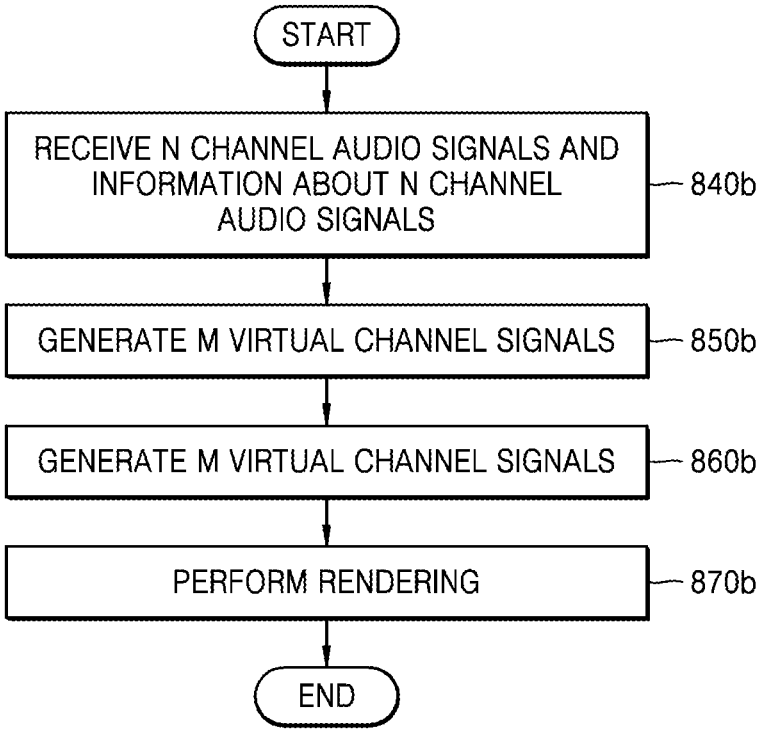
FIG. 8B show a flowchart of a method of reproducing audio according to an embodiment of the present.

FIG. 8B is a flowchart of a method of reproducing audio, according to an embodiment of the present invention.

The audio reproduction apparatus 300 according to the embodiment disclosed in FIG. 8B receives a bitstream in which the N channel audio signals and the information about the N channel audio signals are encoded, in operation 840*b*, and decodes the corresponding bitstream by using the codec used in the encoding.

The audio reproduction apparatus 300 generates M virtual channel signals based on the decoded N channel audio signals and an object audio signal in operation 850*b*. M is an integer greater than N, and the M virtual channel signals may be generated by weighted-summing the N channel signals. In this case, weights to be applied to the weighted sum are determined based on a layout of input channels and a reproduction layout.

A detailed method of generating a virtual channel has been described with reference to FIG. 5, and thus a detailed description thereof is omitted.

As a more number of virtual channels are generated, channel coherence may be higher, or when coherence between channel signals is high due to original channels adjacent to each other, reproduction performance may be deteriorated. Therefore, the reproduction apparatus 300 performs channel separation to reduce coherence between signals in operation 860*b*.

A detailed method of channel-separating a sound image has been described with reference to FIG. 5, and thus a detailed description thereof is omitted.

The reproduction apparatus 300 performs rendering by using a signal in which a sound image has been channel-separated, in operation 870*b*. Audio rendering is a process of converting an input audio signal into an output audio signal such that the input audio signal can be reproduced according to an output system, and includes an up-mixing or down-mixing process if a number of input channels differs from a number of output channels. A rendering method is described below with reference to FIG. 12 and others.

FIG. 9 shows a flowchart of a method of generating audio and a flowchart of a method of reproducing audio, according to another embodiment of the present invention. The embodiment disclosed in FIG. 9 assumes that the above-described process of generating a virtual channel and channel-separating a sound image is performed by an audio generation apparatus.

Figure 9A:
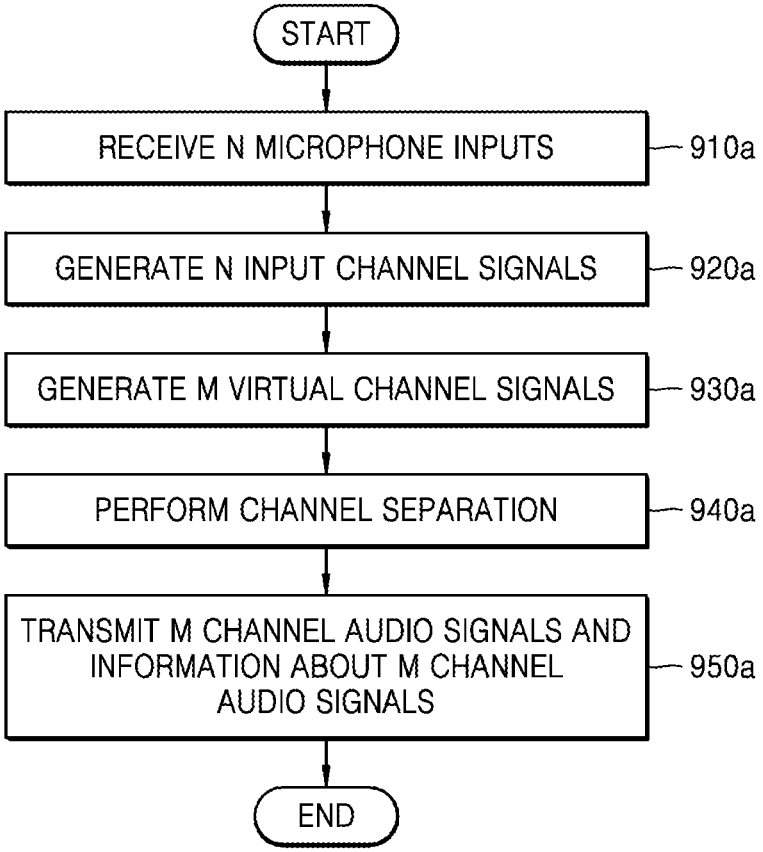
FIG. 9A show a flowchart of a method of generating audio according to another embodiment of the present.

FIG. 9A is a flowchart of a method of generating audio, according to another embodiment of the present invention.

The audio generation apparatus 100 according to the embodiment disclosed in FIG. 9A receives input audio signals from N microphones in operation 910*a* and generates N input channel signals corresponding to the signals received from the respective microphones in operation 920*a*.

The audio generation apparatus 100 generates M virtual channel audio signals based on the N channel audio signals and an object audio signal in operation 930*a*. M is an integer greater than N, and the M virtual channel audio signals may be generated by weighted-summing the N channel audio signals. In this case, weights to be applied to the weighted sum are determined based on a layout of input channels and a reproduction layout.

A detailed method of generating a virtual channel has been described with reference to FIG. 4, and thus a detailed description thereof is omitted.

As a more number of virtual channels are generated, channel coherence may be higher, or when coherence between channel signals is high due to original channels adjacent to each other, reproduction performance may be deteriorated. Therefore, the generation apparatus 100 performs channel separation to reduce coherence between signals in operation 940*a*.

A detailed method of channel-separating a sound image has been described with reference to FIG. 5, and thus a detailed description thereof is omitted.

The audio generation apparatus 100 transmits generated M channel audio signals and information about the M channel audio signals to the audio reproduction apparatus 300 in operation 950*a*. In this case, the audio signals and the information about the audio signals are encoded to a bitstream based on an appropriate codec and transmitted, and the information about the audio signals may be configured as metadata defined by the codec and encoded to a bitstream.

If the codec supports an object audio signal, the audio signal may include an object audio signal. Herein, the information about the M channel audio signals may include information about a location at which each channel signal is to be reproduced, and in this case, the information about a location at which each channel signal is to be reproduced may vary along time.

For example, when birdsong is implemented as an object audio signal, a location at which the birdsong is to be reproduced varies along a path through which a bird moves, and thus a location at which a channel signal is to be reproduced varies along time.

Figure 9B:
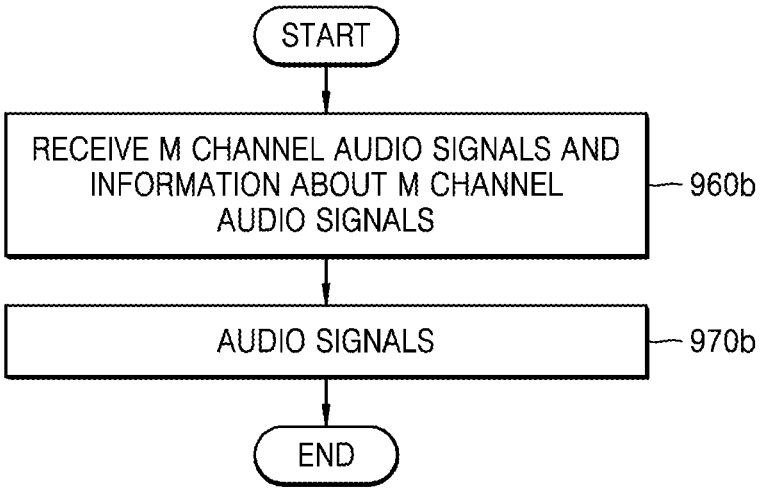
FIG. 9B show a flowchart of a method of reproducing audio according to another embodiment of the present.

FIG. 9B is a flowchart of a method of reproducing audio, according to another embodiment of the present invention.

The audio reproduction apparatus 300 according to the embodiment disclosed in FIG. 9B receives a bitstream in which the M channel audio signals and the information about the M channel audio signals are encoded, in operation 960*b*, and decodes the corresponding bitstream by using the codec used in the encoding.

The reproduction apparatus 300 performs rendering by using the decoded M channel signals in operation 970*b*. Audio rendering is a process of converting an input audio signal into an output audio signal such that the input audio signal can be reproduced according to an output system, and includes an up-mixing or down-mixing process if a number of input channels differs from a number of output channels. A rendering method is described below with reference to FIG. 12 and others.

FIG. 10 shows a flowchart of a method of generating audio and a flowchart of a method of reproducing audio, according to another embodiment of the present invention. The embodiment disclosed in FIG. 11 assumes that a process of generating a virtual channel is performed by an audio generation apparatus and a process of channel-separating a sound image is performed by an audio reproduction apparatus.

Figure 10A:
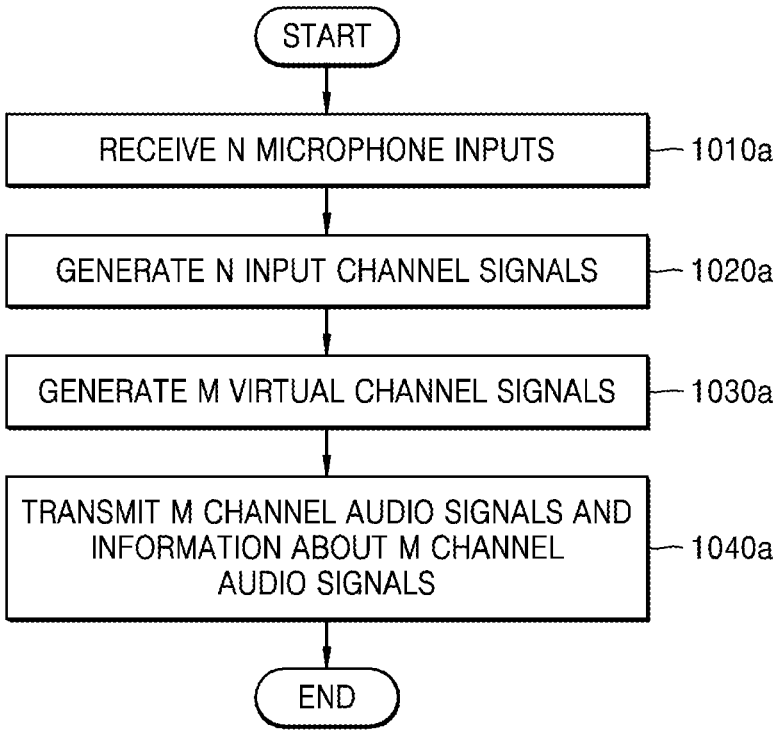
FIG. 10A show a flowchart of a method of generating audio according to another embodiment of the present.

FIG. 10A is a flowchart of a method of generating audio, according to another embodiment of the present invention.

The audio generation apparatus 100 according to the embodiment disclosed in FIG. 10A receives input audio signals from N microphones in operation 1010*a* and generates N input channel signals corresponding to the signals received from the respective microphones in operation 1020*a*.

The audio generation apparatus 100 generates M virtual channel signals based on the N channel audio signals and an object signal in operation 1030*a*. M is an integer greater than N, and the M virtual channel signals may be generated by weighted-summing the N channel audio signals. In this case, weights to be applied to the weighted sum are determined based on a layout of input channels and a reproduction layout.

A detailed method of generating a virtual channel has been described with reference to FIG. 4, and thus a detailed description thereof is omitted.

The audio generation apparatus 100 transmits generated M channel audio signals and information about the M channel audio signals to the audio reproduction apparatus 300 in operation 1040*a*. In this case, the audio signals and the information about the audio signals are encoded to a bitstream based on an appropriate codec and transmitted, and the information about the audio signals may be configured as metadata defined by the codec and encoded to a bitstream.

If the codec supports an object audio signal, the audio signal may include an object audio signal. Herein, the information about the M channel audio signals may include information about a location at which each channel signal is to be reproduced, and in this case, the information about a location at which each channel signal is to be reproduced may vary along time.

For example, when birdsong is implemented as an object audio signal, a location at which the birdsong is to be reproduced varies along a path through which a bird moves, and thus a location at which a channel signal is to be reproduced varies along time.

Figure 10B:
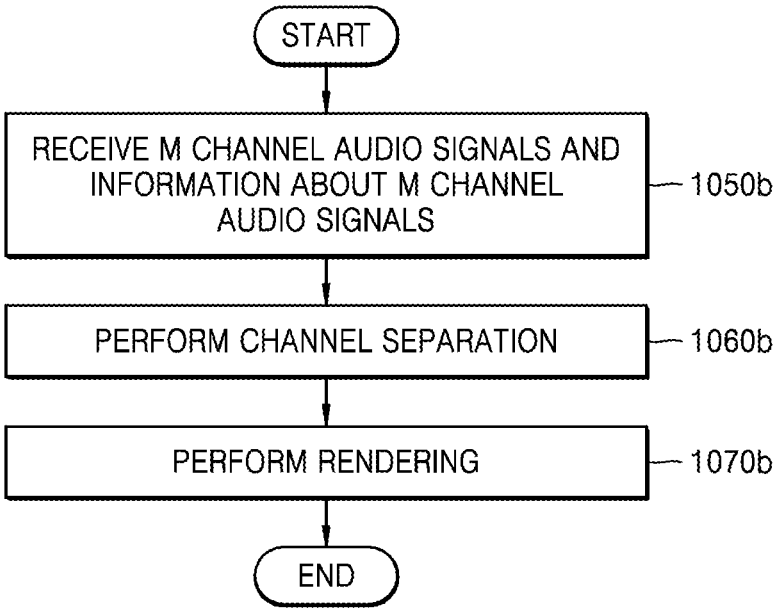
FIG. 10B show a flowchart of a method of reproducing audio according to another embodiment of the present.

FIG. 10B is a flowchart of a method of reproducing audio, according to another embodiment of the present invention.

The audio reproduction apparatus 300 according to the embodiment disclosed in FIG. 10B receives a bitstream in which the M channel audio signals and the information about the M channel audio signals are encoded, in operation 1050*b*, and decodes the corresponding bitstream by using the codec used in the encoding.

As a more number of virtual channels are generated, channel coherence may be higher, or when coherence between channel signals is high due to original channels adjacent to each other, reproduction performance may be deteriorated. Therefore, the generation apparatus 100 performs channel separation to reduce coherence between signals in operation 1060*b*.

A detailed method of channel-separating a sound image has been described with reference to FIG. 5, and thus a detailed description thereof is omitted.

The reproduction apparatus 300 performs rendering by using a signal in which a sound image has been channel-separated, in operation 1070*b*. Audio rendering is a process of converting an input audio signal into an output audio signal such that the input audio signal can be reproduced according to an output system, and includes an up-mixing or down-mixing process if a number of input channels differs from a number of output channels. A rendering method is described below with reference to FIG. 13 and others.

FIG. 11 illustrates an audio reproduction system capable of reproducing an audio signal in a range of 360° horizontally.

Along with the technical development and demand increase in 3D content, the necessity of a device and system capable of reproducing 3D content has increased. 3D content may include all information about a 3D space. A range which a user can recognize a sense of space in a vertical direction is limited, but the user can recognize a sense of space in a horizontal direction in the entire range of 360° with the same sensitivity.

Therefore, recently developed 3D content reproduction systems have an environment in which a 3D image and audio content produced in a range of 360° horizontally can be reproduced.

Figure 11A:
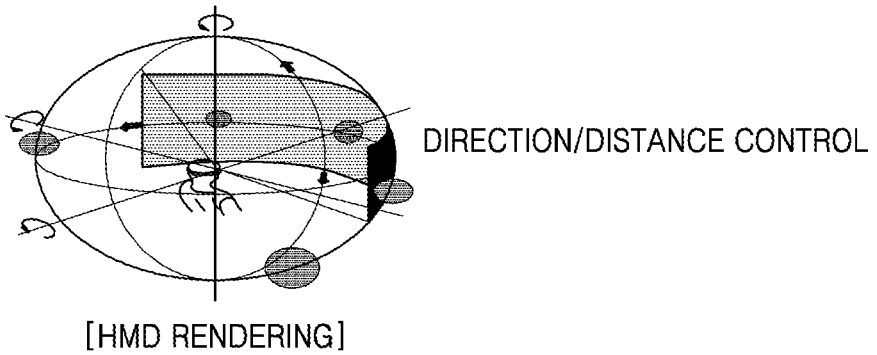
FIG. 11A show an embodiment of a HMD (Head Mounded Display) system.

FIG. 11A illustrates a head mounted display (HMD). The HMD indicates a display device of a head wearing type. The HMD is usually used to implement virtual reality (VR) or augmented reality (AR).

VR is a technology of artificially generating a specific environment or situation such that a user interacts with an actual surrounding situation and environment. AR is a technology of overlapping a virtual object with reality recognized by a user with naked eyes such that the user views the virtual object and the reality. Since AR mixes a virtual world having additional information with the real world in real-time such that a user views a single image, AR is also called mixed reality (MR).

To implement VR and AR, wearable devices worn around a human body and the like are used, and a representative system thereof is the HMD.

The HMD has a display located closely to the eyes of the user, and thus when an image is displayed by using the HMD, the user may feel a relatively high sense of immersion. In addition, a large screen may be implemented with a small-sized device, and 3D or 4D content may be reproduced.

Herein, an image signal is reproduced through the HMD worn around a head, and an audio signal may be reproduced through headphones equipped in the HMD or separate headphones. Alternatively, the image signal is reproduced through the HMD, and the audio signal may be reproduced through a general audio reproduction system.

The HMD may be configured in an integrated type including a controller and a display therein or configured with a separate mobile terminal such as a smartphone such that the mobile terminal operates as a display, a controller, and the like.

Figure 11B:
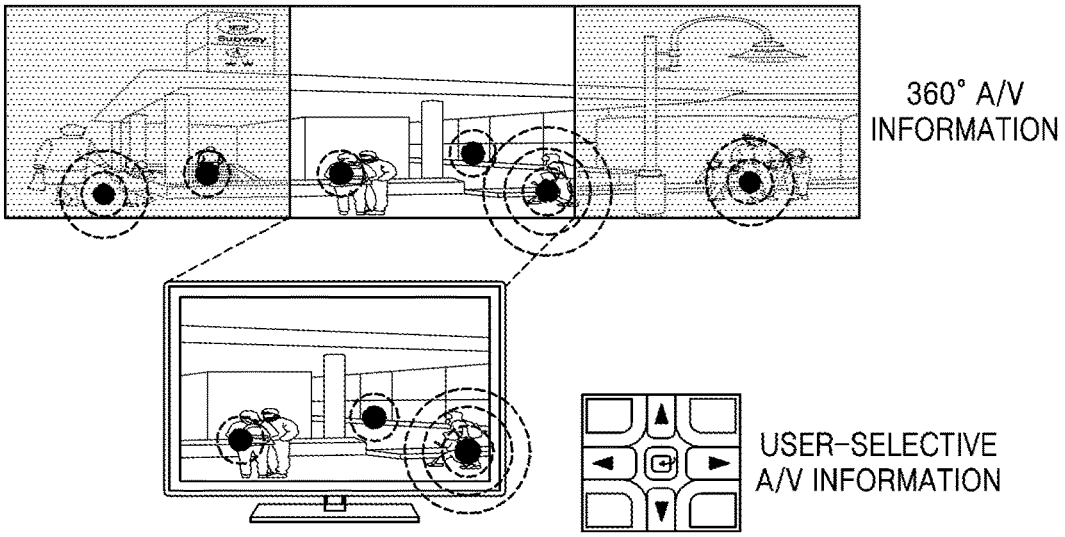
FIG. 11B shows an embodiment of a HTS(Home Theater System).

FIG. 11B illustrates a home theater system (HTS).

The HTS is a system for implementing an image with high image quality and audio with high sound quality at home such that a user can enjoy movie with a sense of reality, and since the HTS includes an image display for implementing a large screen and a surround audio system for high sound quality, the HTS corresponds to a most general multi-channel audio output system installed at home.

There are various multi-channel standards for an audio output system, such as 22.2-channel, 7.1-channel, and 5.1-channel standards, but a layout of output channels, which has been most supplied as a home theater standard, is 5.1 channels or 5.0 channels including a center channel, a left channel, a right channel, a surround left channel, and a surround right channel and additionally including a woofer channel according to circumstances.

To reproduce 3D content, a technique of controlling a distance and a direction may be applied. When a content reproduction distance is short, content of a relatively narrow region is displayed at a wide angle, and when the content reproduction distance is long, content of a relatively wide region is displayed. Alternatively, a content reproduction direction is changed, content of a region corresponding to the changed direction may be displayed.

An audio signal can be controlled according to a reproduction distance and direction of image content to be displayed, and when the content reproduction distance is shorter than before, a volume (gain) of audio content is increased, and when the content reproduction distance is longer than before, a volume (gain) of audio content is decreased. Alternatively, when a content reproduction direction is changed, audio may be rendered based on the changed direction to reproduce audio content corresponding to a changed reproduction angle.

In this case, the content reproduction distance and reproduction direction may be determined based on a user input or determined based on a motion of a user, particularly, movement and rotation of a head.

Figure 12:
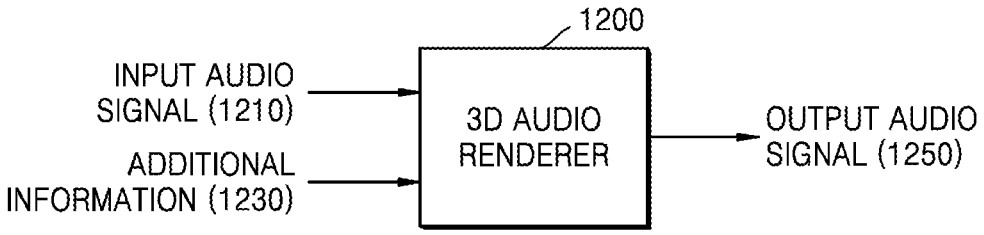
FIG. 12 illustrates a schematic configuration of a three-dimensional (3D) audio renderer in a 3D audio reproduction apparatus, according to an embodiment of the present invention.

FIG. 12 illustrates a schematic configuration of a 3D audio renderer 1200 in a 3D audio reproduction apparatus, according to an embodiment of the present invention.

To reproduce 3D stereophonic audio, a sound image should be positioned in a 3D space through stereophonic audio rendering. As described with reference to FIG. 3, the stereophonic audio rendering includes filtering and panning operations.

The panning operation includes calculating and applying a panning coefficient to be applied for each frequency band and each channel in order to pan an input audio signal with respect to each output channel. The panning on an audio signal indicates controlling a magnitude of a signal to be applied to each output channel in order to render a sound source to a specific location between two output channels.

The filtering includes correcting a tone and the like of a decoded audio signal according to a location and filtering an input audio signal by using a HRTF filter or a BRTF filter.

The 3D audio renderer 1200 receives an input audio signal 1210 including at least one of a channel audio signal and an object audio signal and transmits an output audio signal 1230 including at least one of a rendered channel audio signal and object audio signal to an output unit. Herein, separate additional information may be additionally received as an input, and the additional information may include per-time reproduction location information of the input audio signal, language information of each object, or the like.

When information about a head motion of a user is known, a head positon, a rotating angle of the head, and the like based on the head motion of the user may be additionally included in the additional information. Alternatively, per-time reproduction location information of a corrected input audio signal to which the head positon, the rotating angle of the head, and the like based on the head motion of the user have been reflected may be additionally included in the additional information.

Figure 13:
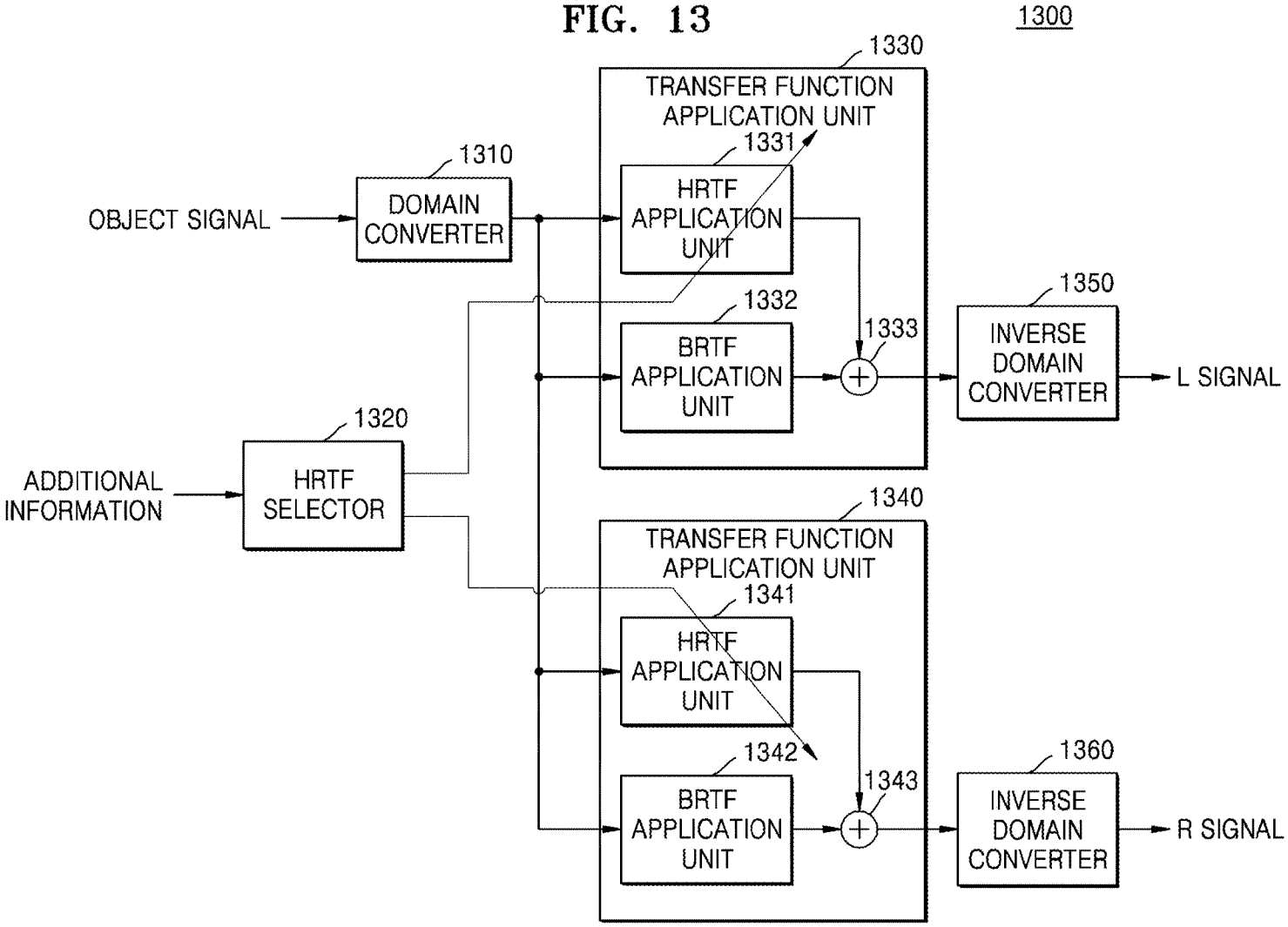
FIG. 13 is a block diagram for describing a rendering method for sound externalization with a low computation amount, according to an embodiment of the present invention.

FIG. 13 is a block diagram for describing a rendering method for sound externalization with a low computation amount, according to an embodiment of the present invention.

As described above, when a user listens to audio content through headphones or earphones, there occurs a sound internalization phenomenon that a sound image recognized inside the head of a user. This phenomenon lowers a sense of space and a sense of reality of audio and affects even the sound image positioning performance. To solve this sound internalization phenomenon, a sound externalization scheme of making a sound image focused on the outside of a head is applied.

For sound externalization, an echo component is simulated through signal processing by using the BRTF which is an expended concept of the HRTF. However, the BRIR used for the sound externalization is used to simulate an echo in a form of a finite impulse response (FIR) filter, and thus a many order of filter taps are generally used.

For the BRIR, a long-tap BRIR filter coefficient corresponding to a left ear/a right ear for each input channel is used. Therefore, for real-time sound externalization, filter coefficients corresponding to "number of channels×binaural room filter coefficient×2" are needed, and in this case, a computation amount is generally proportional to the number of channels and the binaural room filter coefficient.

Therefore, when a number of input channels is large in case of 22.2 channels or the like, when an object input channel is separately supported, or the like, that is, when the number of input channels is large, a computation amount for the sound externalization increases. Therefore, an efficient computation method for preventing a decrease in the performance due to an increase in a computation amount even when the BRIR filter coefficient increases is needed.

An input of a renderer 1400 according to an embodiment of the present invention may be at least one of a decoded object audio signal and channel audio signal, and an output may be at least one of a rendered object audio signal and channel audio signal.

The renderer 1300 according to an embodiment of the present invention, which is disclosed in FIG. 13, includes a domain converter 1310, an HRTF selector 1320, transfer function application units 1330 and 1340, and inverse domain converters 1350 and 1360. The embodiment of the present invention, which is disclosed in FIG. 13, assumes that an object audio signal is rendered by applying a low-computation-amount BRTF.

The domain converter 1310 performs a similar operation to that of the domain converters of FIGS. 6 and 7 and converts a domain of an input first object signal. The domain converter 1310 converts a stereo signal into a stereo signal in the time-frequency domain by using an algorithm such as FFT. The time-frequency domain is used to represent both changes in time and frequency. A signal may be divided into a plurality of frames according to time and frequency values, and a signal in each frame may be represented by a frequency sub-band value in each time slot.

The HRTF selector 1320 transmits a real-time HRTF selected from an HRTF database based on a head motion of a user, which has been input through additional information, to the transfer function application units 1330 and 1340.

When the user listens to an actual sound source outside the head, if a head motion occurs, relative locations of the sound source and two ears, and accordingly, a transfer characteristic changes. Therefore, an HRTF of a direction corresponding to a head motion and location of the user at a specific time point, i.e., "a real-time HRTF", is selected.

Table 1 illustrates an HRTF index table according to real-time head motions.

TABLE 1

| Horizontal user head motion angle (deg) | HRTF target angle for sound image of 90° (deg) |
|---|---|
| 0 | 90 |
| 30 | 60 |
| 60 | 30 |
| 90 | 0 |
| 120 | −30 |
| 150 | −60 |
| 180 | −90 |
| 210 | −120 |
| 240 | −150 |
| 270 | −180 |
| 300 | −210 |

In a sound externalization method connectable to a real-time head motion, a location at which a sound image is to be rendered and a head motion of the user may be compensated for and externalized. According to an embodiment of the present invention, head motion location information of the user may be received as additional information, and according to another embodiment of the present invention, both head motion location information of the user and a location at which a sound image is to be rendered may be received as additional information.

Table 1 shows an HRTF corrected when the head of the user has rotated when it is desired to perform sound externalization rendering such that a sound image is reproduced at a location having a horizontal left azimuth angle of 90° and an elevation angle of 0°. As described above, when HRTFs to be reflected to input additional information are stored in advance as a table with indices, real-time head motion correction is possible.

In addition, even for a case other than the headphone rendering as described above, an HRTF corrected for tone correction may be used according to circumstances for stereophonic audio rendering.

In this case, the HRTF database may previously have a value obtained by domain-converting an HRIR for each reproduction location into an HRIR in the frequency domain, or the HRTF database may be modeled and acquired by a method such as principal component analysis (PCA) or pole-zero modeling in order to reduce a data size.

Since the embodiment disclosed in FIG. 13 is a renderer for rendering one input channel signal or one object signal to two headphone output channels (left channel and right channel), two transfer function application units 1330 and 1340 are required. The transfer function application units 1330 and 1340 apply a transfer function to the audio signal received from the domain converter 1310 and further include HRTF application units 1331 and 1341 and BRTF application units 1332 and 1342.

Since an operation of the transfer function application unit 1330 for a left output channel is the same as an operation of the transfer function application unit 1340 for a right output channel, a description is made based on the transfer function application unit 1330 for the left output channel.

The HRTF application unit 1331 of the transfer function application unit 1330 applies the real-time HRTF of the left output channel, which has been transmitted from the HRTF selector 1320, to the audio signal received from the domain converter 1310. The BRTF application unit 1332 of the transfer function application unit 1330 applies a BRTF of the left output channel. In this case, the BRTF is used as a fixed value instead of a real-time varying value. Since a characteristic of a space is applied to the BRTF corresponding to an echo component, a length of an echo and a number of filter taps rather than a change along time affect the rendering performance more.

The real-time HRTF of the left output channel, which is applied by the HRTF application unit 1331, corresponds to a value (early HRTF) obtained by domain-converting, into the frequency domain, a time response before a predetermined reference time (early HRIR) among original HRTFs. In addition, the BRTF of the left output channel, which is applied by the BRTF application unit 1432, corresponds to a value (late BRTF) obtained by domain-converting, into the frequency domain, a time response after the predetermined reference time (late BRIR) among original BRTFs.

That is, the transfer function applied by the transfer function application unit 1330 is a transfer function obtained by domain-converting, into the frequency domain, an impulse response to which an HRIR has been applied before the predetermined reference time and a BRIR has been applied after the predetermined reference time.

The audio signal to which a real-time HRTF has been applied by the HRTF application unit 1331 and the audio signal to which a BRTF has been applied by the BRTF application unit 1332 are added by a signal adder 1333 and transmitted to the inverse domain converter 1350.

The inverse domain converter 1350 generates a left channel output signal by converting the signal, which has been converted into the frequency domain, into a signal in the time domain again.

Operations of the transfer function application unit 1340 for the right output channel and the inverse domain converter 1360 for the right output channel are the same as those for the left output channel, and thus a detailed description thereof is omitted.

Figure 14:
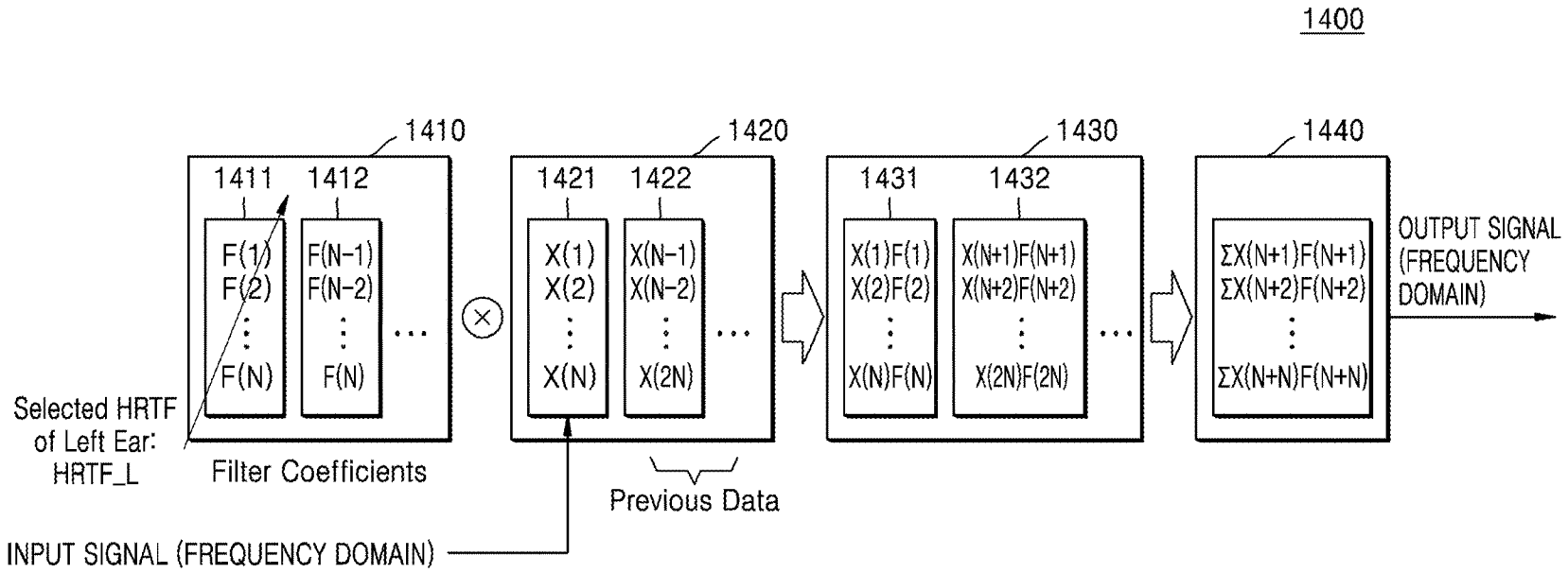
FIG. 14 illustrates formulae representing a specific operation of a transfer function application unit according to an embodiment of the present invention.

FIG. 14 illustrates formulae representing a specific operation of a transfer function application unit according to an embodiment of the present invention.

An impulse response obtained by integrating an HRIR and a BRIR corresponds to a long-tap filter, and in view of block convolution in which convolution is applied by dividing a long-tap filter coefficient into a plurality of blocks, a sound externalization scheme of reflecting a location change along time through data update of a real-time HRTF before a predetermined reference time can be performed as shown in FIG. 14. The block convolution is an operation method for efficiently convoluting a signal having a long sequence and corresponds to an overlap add (OLA) method.

FIG. 14 illustrates a detailed operation method of BRIR-HRIR rendering for low-computation-amount sound externalization in a transfer function application unit 1400, according to an embodiment of the present invention.

1410 denotes a BRIR-HRIR integrated filter coefficient F, an arrow in a first column indicates reflection of a real-time HRTF, and one column has N elements. That is, the first column 1411 (F(1), F(2), . . . , F(N)) of 1410 corresponds to a filter coefficient to which a real-time HRTF has been reflected, and a second column 1412 (F(N+1), F(N+2), . . . , F(2N)) and next columns correspond to filter coefficients to which a BRTF for rendering an echo has been reflected.

1420 denotes an input in the frequency domain, i.e., a signal X domain-converted into the frequency domain through the domain converter 1310. A first column 1421 (X(1), X(2), . . . , X(N)) of the input signal 1420 corresponds to a frequency input sample at a current time, and a second column 1422 (X(N+1), X(N+2), . . . , X(2N)) and next columns correspond to data already input before the current time.

The filter coefficient 1410 and the input 1420 configured as described above are multiplied column by column (1430). That is, the first column 1411 of the filter coefficient is multiplied by the first column 1421 of the input (1431, F(1)X(1), F(2)X(2), . . . , F(N)X(N)), and the second column 1412 of the filter coefficient is multiplied by the second column 1422 of the input (1432, F(N+1)X(N+1), F(N+2)X(N+2), . . . , F(2N)X(2N)). When the column-by-column product operation is completed, factors of each row are added to generate N output signals 1440 in the frequency domain. That is, an $n^{th}$ sample value of the N output signals is $\Sigma F(1N+n)X(1N+n)$.

Since an operation of the transfer function application unit 1340 for a right output channel is the same as an operation of the transfer function application unit 1330 for a left output channel, a detailed description thereof is omitted.

Figure 15:
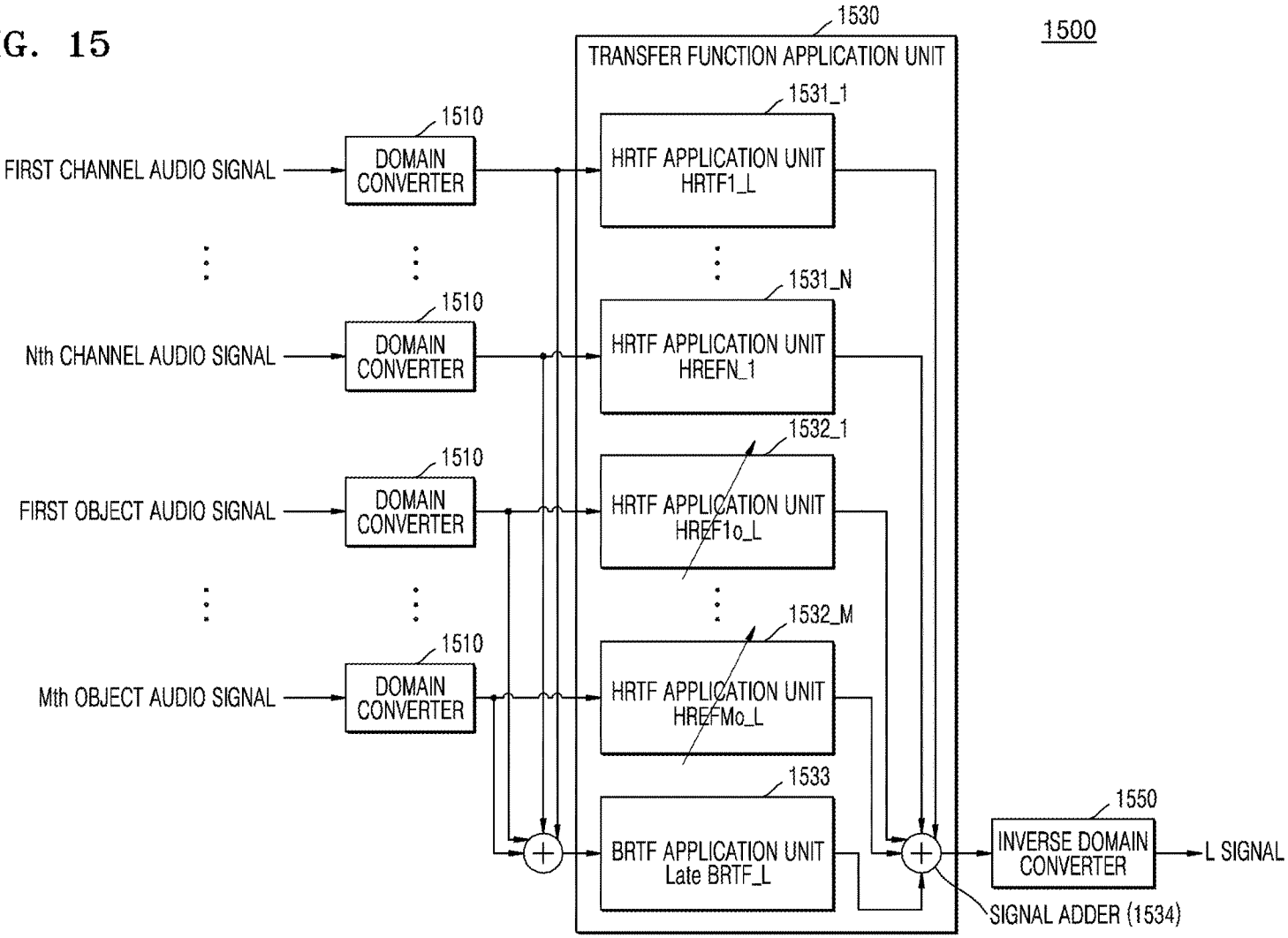
FIG. 15 is a block diagram of a device for rendering a plurality of channel inputs and a plurality of object inputs, according to an embodiment of the present invention.

FIG. 15 is a block diagram of a device 1500 for rendering a plurality of channel inputs and a plurality of object inputs, according to an embodiment of the present invention.

In FIG. 13, a case in which one object input is rendered has been assumed. If it is assumed that N channel audio signals and M object audio signals are input, FIG. 13 can be extends to FIG. 15. However, even in FIG. 15, since processing on a left output channel is the same as processing on a right output channel, a description is made only based on a rendering device for the left output channel.

When the N channel audio signals and the M object audio signals are input, each input signal is converted into a stereo signal in the time-frequency domain by using an algorithm such as FFT. The time-frequency domain is used to represent both changes in time and frequency. A signal may be divided into a plurality of frames according to time and frequency values, and a signal in each frame may be represented by a frequency sub-band value in each time slot.

In the embodiment of FIG. 15, the contents about an HRTF selector and additional information are omitted, but it may be implemented as in FIG. 13 that an HRTF is selected based on input additional information, wherein, with regard to a channel audio signal, an HRTF may be selected based on a head motion and location of a user, and with regard to an object audio signal, a reproduction location of the object audio signal may be additionally considered in addition to the head motion and location of the user.

A transfer function application unit 1530 applies a corresponding transfer function to each of the (N+M) domain-converted input signals. In this case, with regard to, the transfer function corresponding each of the (N+M) input signals, a unique HRTF (early HRTF) may be applied before a predetermined reference time, and the same BRTF (late BRTF) may be applied after the predetermined reference time.

In this implementation described above, compared with application of different transfer functions to all of the (N+M) input signals, a computation amount is reduced, and actual deterioration of the headphone rendering performance does not largely occur.

The (N+M) input signals to which respective transfer functions have been applied by the transfer function application unit 1530 are added by a signal adder and transmitted to an inverse domain converter 1550. The inverse domain converter 1550 generates a left channel output signal by converting the signal, which has been converted into the frequency domain, into a signal in the time domain again.

Operations of a transfer function application unit for the right output channel and an inverse domain converter for the right output channel are the same as those for the left output channel, and thus a detailed description thereof is omitted.

Figure 16:
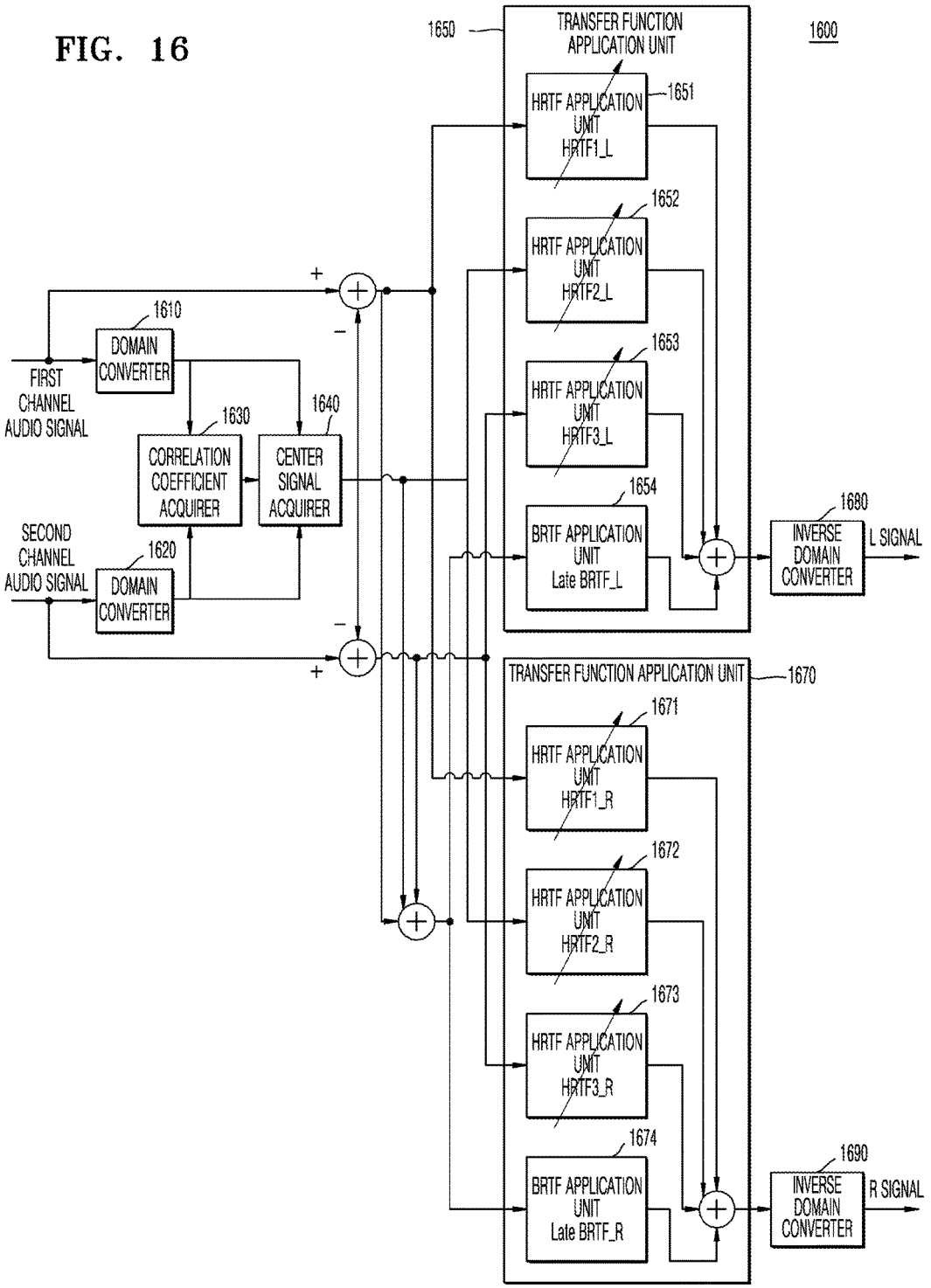
FIG. 16 is a block diagram of a configuration in which a channel separator and a renderer are integrated, according to an embodiment of the present invention.

FIG. 16 is a block diagram of a configuration in which a channel separator and a renderer are integrated, according to an embodiment of the present invention.

FIG. 16 illustrates an integration of FIGS. 6 and 13, and the embodiment disclosed in FIG. 16 is to generate left and right ambient channels by separating a center channel from an audio signal having two input channels (N=2) and then to BRIR-HRIR-render the separated center channel and the generated left and right ambient channels (M=3).

In this case, a transfer function application unit may be more clearly render a sound image by using a same number of HRTFs as a number of the channel-separated signals (M=3) instead of using a same number of transfer functions as a number of the input signals (N=2).

Although only a center channel is separated from left and right input channels in the embodiment disclosed in FIG. 16, the present embodiment is not limited thereto, and it would be obvious to those of ordinary skill in the art that a more number of virtual channels may be generated and each of the generated virtual channels may be rendered.

Figure 17:
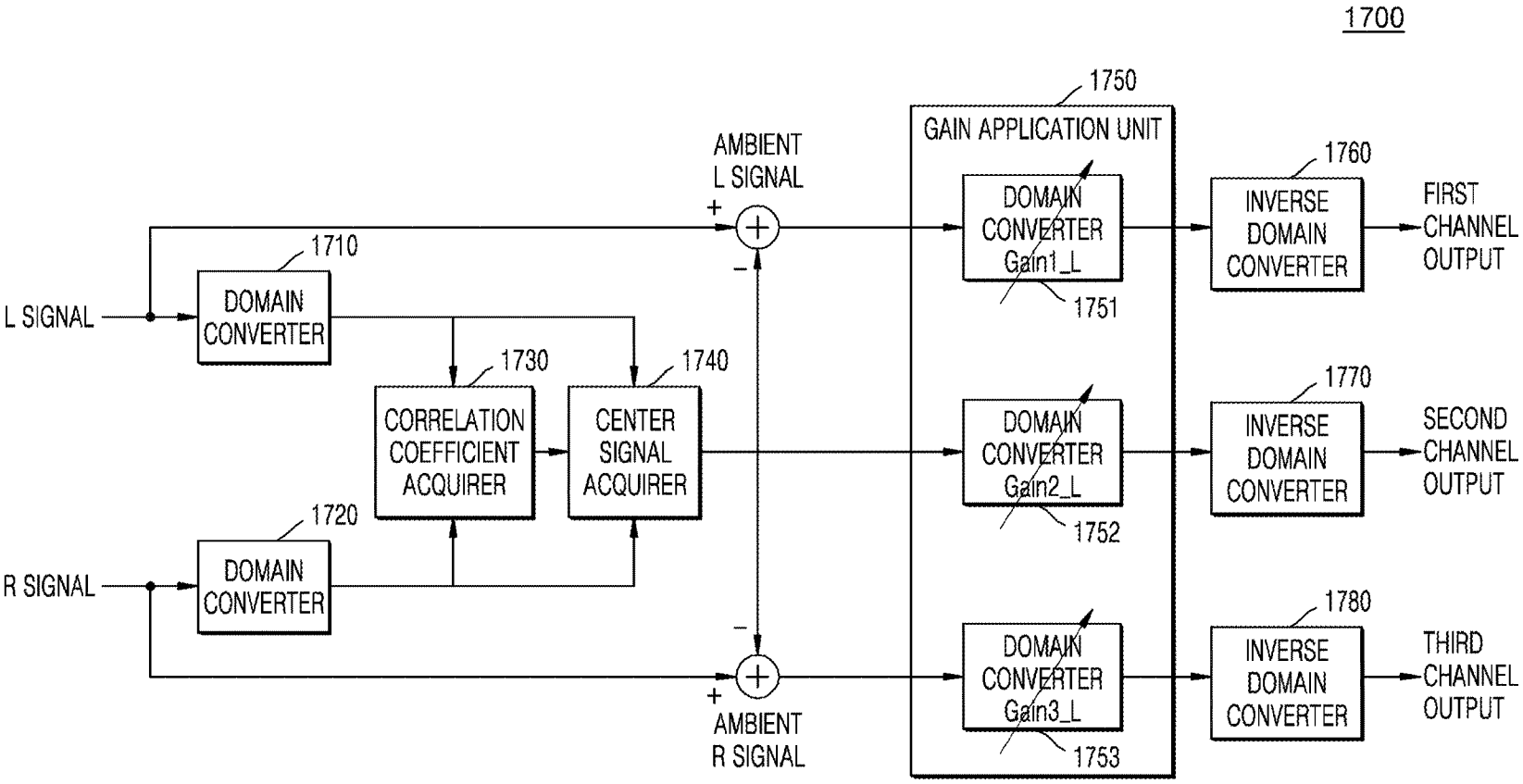
FIG. 17 is a block diagram of a configuration in which a channel separator and a renderer are integrated, according to another embodiment of the present invention.

FIG. 17 is a block diagram of a configuration in which a channel separator and a renderer are integrated, according to another embodiment of the present invention.

FIG. 17 illustrates an integration of the channel separator and the renderer shown in FIG. 6, and the embodiment disclosed in FIG. 17 is to generate left and right ambient channels by separating a center channel from an audio signal having two input channels (N=2) and then to pan the separated center channel and the generated left and right ambient channels (M=3). In this case, a panning gain is determined based on layouts of each input channel and an output channel.

Although only a center channel is separated from left and right input channels in the embodiment disclosed in FIG. 17, the present embodiment is not limited thereto, and it would be obvious to those of ordinary skill in the art that a more number of virtual channels may be generated and each of the generated virtual channels may be rendered.

In this case, as described above with reference to FIG. 12 and the like, if necessary for 3D audio rendering, tone correction filtering may be additionally performed by using an HRTF (not shown). In addition, if a number of output channels differs from a number of input (virtual) channels, an up-mixer or a down-mixer (not shown) may be additionally included.

Figure 18:
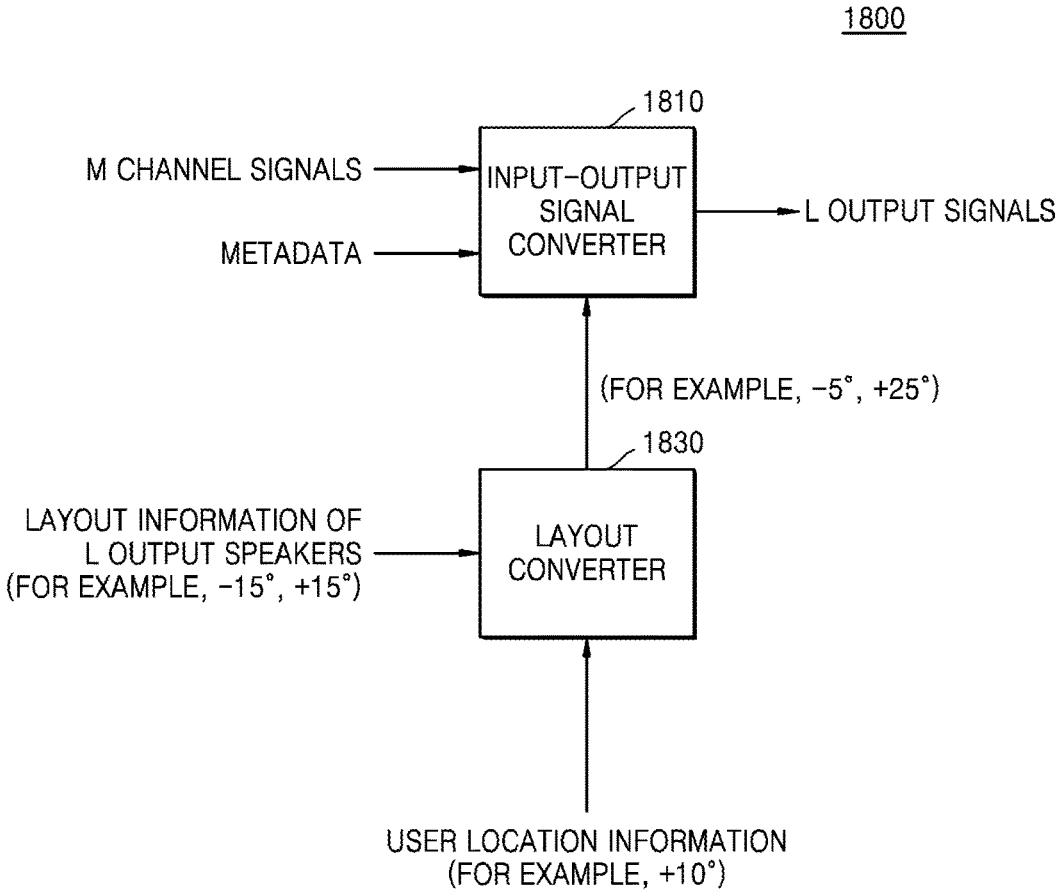
FIG. 18 is a block diagram of a renderer including a layout converter, according to an embodiment of the present invention.

FIG. 18 is a block diagram of a renderer including a layout converter, according to an embodiment of the present invention.

The renderer according to the embodiment disclosed in FIG. 18 further includes a layout converter 1830 besides an input-output signal converter 1810 for converting an input channel signal into an output channel signal.

The layout converter 1830 receives output speaker layout information about installation locations and the like of L output speakers and head position information of a user. The layout converter 1830 converts a layout of the output speakers based on the head position information of the user.

For example, it is assumed that installation locations of two output speakers are left and right 15°, i.e., +15° and −15°, and the user turns the head by 10° to the right, i.e., +10°. In this case, a layout of the output speakers should be changed from original +15° and −15° to +25° and −5°, respectively.

The input-output signal converter 1810 receives the converted output channel layout information from the layout converter and converts (renders) input-output signals based on the received output channel layout information. In this case, according to the embodiment shown in FIG. 18, since a number M of input channels is 5 and a number L of output channels is 2, the input-output signal converter includes a down-mixing process.

FIG. 19 illustrates a change in an output channel layout based on user head position information, according to an embodiment of the present invention.

In FIG. 19, it is assumed according to the embodiment disclosed in FIG. 18 that the number M of input channels is 5, the number L of output channels is 2, installation locations of two output speakers are left and right 15°, i.e., +15° and −15°, and the user turns the head by 10° to the right, i.e., +10°.

Figure 19A:
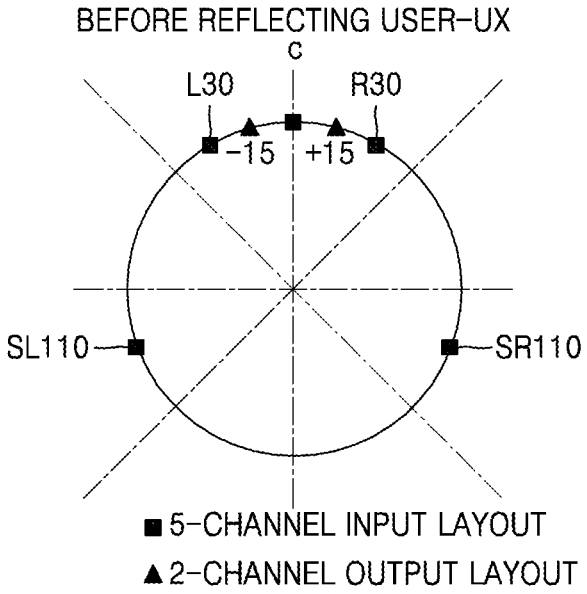
FIG. 19A illustrates input and output channel locations before head position information of a user is reflected.

FIG. 19A illustrates input and output channel locations before head position information of a user is reflected. The number M of input channels is 5, and the input channels includes a center channel (0), a right channel (+30), a left channel (−30), a surround right channel (+110), and a surround left channel (−110). The number L of output channels is 2, and the output speakers are located at left and right 15°, i.e., +15° and −15°.

Figure 19B:
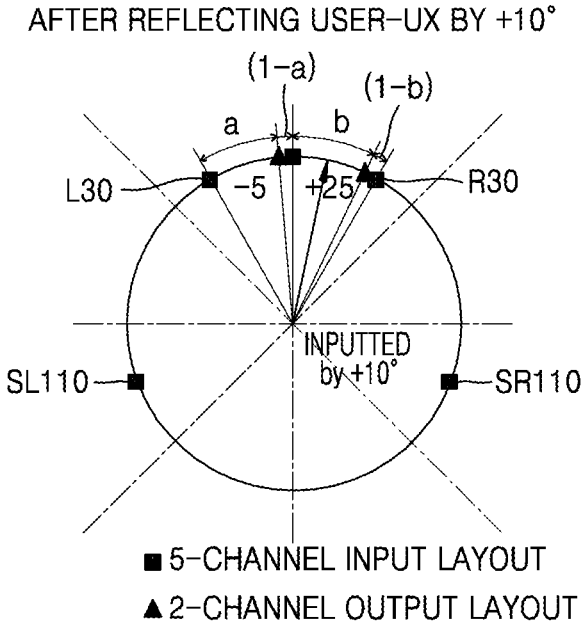
FIG. 19B illustrates input and output channel locations after locations of the output channels are changed by reflecting the head position information of the user.

FIG. 19B illustrates input and output channel locations after locations of the output channels are changed by reflecting the head position information of the user. The locations of the input channels are not changed, and the changed locations of the output channels are +25° and −5°.

In this case, the left and right output channel signals are determined by Equation 13.

$$y_L = a \times x_{-30} + (1-a) \times x_0$$

$$y_R = b \times x_0 + (1-b) \times x_{+30} \quad (13)$$

where a and b scaling constants determined based on a distance between an input channel and an output channel or an azimuth angle difference.

Figure 20:
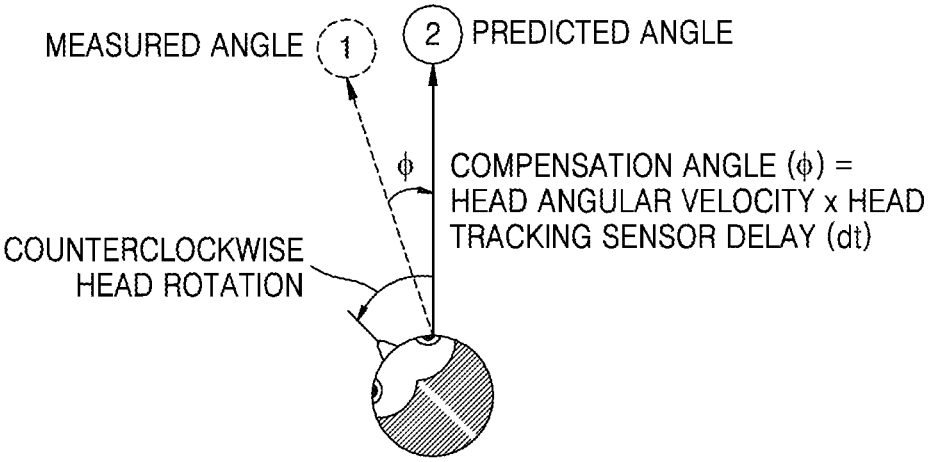
FIGS. 20 and 21 illustrate a method of compensating for a delay of a capturing device or a device for tracking the head of a user, according to an embodiment of the present invention.
Figure 21:
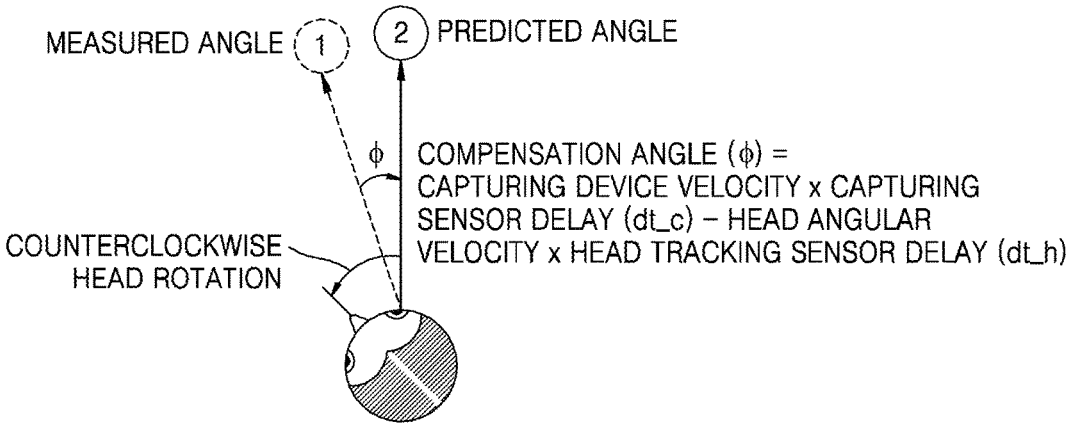

FIGS. 20 and 21 illustrate a method of compensating for a delay of a capturing device or a device for tracking the head of a user, according to an embodiment of the present invention.

FIG. 20 illustrates a method of compensating for a user head tracking delay. The user head tracking delay is determined based on a head motion of the user and a delay of a head tracking sensor.

In FIG. 20, when the user rotates the head counterclockwise, even though the user has actually rotated the head by 1, the head tracking sensor may sense a direction of 2 as a head direction of the user due to a delay of the sensor.

In this case, a head angular velocity is calculated according to a head moving speed of the user, and a compensation angle ϕ is compensated or a location is compensated to 1 by multiplying the calculated head angular velocity by a delay dt of the head tracking sensor. An interpolation angle or location may be determined based on the compensated angle or location, and an audio signal may be rendered based on the interpolation angle or location. This is arranged with regard to the compensation angle as Equation 14.

$$\text{Compensation angle } \phi = \text{head angular velocity} \times \text{head tracking sensor delay } dt \quad (14)$$

When this method is used, angle or location mismatch which may occur due to a sensor delay may be compensated for.

When a velocity is calculated, a velocity sensor may be used, and when an accelerometer is used, a velocity may be obtained by integrating an acceleration along time. In the embodiment of FIG. 21, an angle may include head moving angles (roll, pitch, and yaw) with regard to a location of a virtual speaker, which has been set by the user, or on 3D axes.

FIG. 21 illustrates a method of compensating for delays of a capturing device and a user head tracking device when an audio signal captured by a device attached to a moving object is rendered.

According to an embodiment of the present invention, when capturing is performed by attaching the capturing device to a moving object such as a drone or vehicle, real-time location information (location, angle, velocity, angular velocity, and the like) of the capturing device may be configured as metadata and transmitted to a rendering device together with a capturing audio signal.

According to another embodiment of the present invention, the capturing device may receive location information commanded from a separate device attached with a controller such as a joystick or a smartphone remote control and change a location of the capturing device by reflecting the received location information. In this case, metadata of the capturing device may include location information of the separate device.

A delay may occur in each of a plurality of devices and sensors. Herein, the delay may include a time delay from a command of the controller to a response of a sensor of the capturing device and a delay of a head tracking sensor. In this case, compensation can be performed by a method similar to the embodiment disclosed in FIG. 20.

The compensation angle is determined by Equation 15.

$$\text{Compensation angle } \phi = \text{capturing device velocity} \times \text{capturing sensor delay}(dt_c) - \text{head angular velocity} \times \text{head tracking sensor delay } dt_h \quad (15)$$

A length of a filter used in the above-described rendering method connectable to a head motion affects a delay of a final output signal. When a length of a rendering filter is too long, a sound image of an output audio signal cannot follow a head moving speed, and thus the sound image may not be pin-pointed according to a head motion and may be thus blurred, or location information between an image and a sound image may not match, thereby decreasing a sense of reality.

As a method of adjusting a delay of a final output signal, a length of the entire filter to be used may be adjusted, or when a long-tap filter is used, a length N of an individual block to be used for block convolution may be adjusted.

Determination of a filter length for sound image rendering should be designed such that a location of a sound image can be maintained even when a head motion is changed after sound image rendering, and thus a maximum delay should be designed such that the location of the sound image can be maintained in consideration of a head moving direction and speed of the user. In this case, the designed maximum delay should be determined so as not to exceed a total input-output delay of an audio signal.

For example, when the total input-output delay of an audio signal is determined by a delay after applying a sound image rendering filter, a head position estimation delay of the user head tracking device, and other algorithm delays, a delay to be applied to the sound image rendering filter is determined by Equations 15 through 17.

$$\text{Designed maximum delay} > \text{total input-output delay of audio signal} \quad (15)$$

$$\text{Total input-output delay of audio signal} = \text{sound image rendering filter-applied delay} + \text{head position estimation delay of head tracking device} + \text{other algorithm delays} \quad (16)$$

$$\text{Sound image rendering filter-applied delay} < \text{designed maximum delay} - \text{head position estimation delay of head tracking device} - \text{other algorithm delays} \quad (17)$$

For example, when the maximum delay selected by a designer is 100 ms, the head position estimation delay of the head tracking device is 40 ms, and the other algorithm delays are 10 ms, a length of the sound image rendering filter should be determined such that the delay after applying the sound image rendering filter does not exceed 50 ms.

The above-described embodiments according to the present invention may be implemented as computer instructions which may be executed by various computer components, and recorded on a non-transitory computer-readable recording medium. The non-transitory computer-readable recording medium may include program commands, data files, data structures, or a combination thereof. The program commands recorded on the non-transitory computer-readable recording medium may be specially designed and constructed for the present invention or may be known to and usable by one of ordinary skill in a field of computer software. Examples of the non-transitory computer-readable medium include magnetic media such as hard discs, floppy discs, or magnetic tapes, optical media such as compact disc-read only memories (CD-ROMs) or digital versatile discs (DVDs), magneto-optical media such as floptical discs, and hardware devices that are specially configured to store and carry out program commands (e.g., ROMs, RAMs, or flash memories). Examples of the program commands include a high-level language code that may be executed by a computer using an interpreter as well as a machine language code made by a complier. The hardware devices may be changed to one or more software modules for performing processing according to the present invention, and vice versa.

While the present invention has been described with reference to specific features such as specific components, limited embodiments, and the drawings, these are only provided to help the general understanding of the present invention, and the present invention is not limited the embodiments, and those of ordinary skill in the art to which the present invention belongs could carry out various corrections and modifications from the disclosure.

Therefore, the spirit of the present invention should not be defined by the embodiments described above, and not only the claims below but also all the equivalent or equivalently changed scope of the claims belong to the category of the spirit of the present invention.

The invention claimed is:

1. An audio reproduction method comprising:

receiving a multi-channel audio signal and additional information including a reproduction location of the multi-channel audio signal;

acquiring location information of a user;

channel-separating the received multi-channel audio signal based on the received additional information;

rendering the channel-separated multi-channel audio signal based on the received additional information and the acquired location information of the user; and reproducing the rendered multi-channel audio signal, wherein the channel-separating comprises separating channels based on the additional information and coherence between channel signals included in the multi-channel audio signal.

2. The method of claim 1, further comprising generating a virtual input channel signal based on the received multi-channel audio signal.

3. The method of claim 1, wherein the receiving further comprises receiving an object audio signal.

4. The method of claim 3, wherein the additional information further comprises reproduction location information of the object audio signal.

5. The method of claim 1, wherein the rendering of the multi-channel audio signal comprises:

rendering the multi-channel audio signal based on a head related impulse response (HRIR) with respect to time before a predetermined reference time; and rendering the multi-channel audio signal based on a binaural room impulse response (BRIR) with respect to time after the predetermined reference time.

6. The method of claim 5, wherein the head related impulse response is determined based on the acquired location information of the user.

7. The method of claim 1, wherein the location information of the user is determined based on a user input.

8. The method of claim 1, wherein the location information of the user is determined based on a measured head position of the user.

9. The method of claim 8, wherein the location information of the user is determined based on a head motion speed of the user and a delay of a head motion speed measurement sensor.

10. The method of claim 9, wherein the head motion speed of the user includes at least one of a head angular velocity and a head moving speed.

11. A non-transitory computer-readable recording medium having recorded thereon a computer program for executing the method of claim 1.

12. An audio reproduction apparatus comprising:

a receiver configured to receive a multi-channel audio signal and additional information including a reproduction location of the multi-channel audio signal;

a location information acquirer configured to acquire location information of a user;

a channel separator configured to channel-separate the received multi-channel audio signal based on the received additional information;

a renderer configured to render the channel-separated multi-channel audio signal based on the received additional information and the acquired location information of the user; and a reproducer configured to reproduce the rendered multi-channel audio signal;

wherein the channel separator is configured to separate channels based on the additional information and coherence between channel signals included in the multi-channel audio signal.

13. The audio reproduction apparatus of claim 12, further comprising:

a virtual input channel signal generator configured to generate a virtual input channel signal based on the received multi-channel audio signal.

* * * * *